US009469118B2

(12) United States Patent
Kimura et al.

(10) Patent No.: US 9,469,118 B2
(45) Date of Patent: Oct. 18, 2016

(54) TANK

(71) Applicant: SEIKO EPSON CORPORATION, Tokyo (JP)

(72) Inventors: Naomi Kimura, Nagano (JP); Munehide Kanaya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/935,702

(22) Filed: Nov. 9, 2015

(65) Prior Publication Data

US 2016/0263900 A1 Sep. 15, 2016

(30) Foreign Application Priority Data

Mar. 12, 2015 (JP) ..... 2015-049479

(51) Int. Cl.
*B41J 2/175* (2006.01)
*B41J 2/17* (2006.01)

(52) U.S. Cl.
CPC ..... *B41J 2/1752* (2013.01)

(58) Field of Classification Search
CPC ..... B41J 2/17513; B41J 2/17523; B41J 2/17553; B41J 2/17556; B41J 2/17596; B41J 2/17566; B41J 2/175; B41J 2/17506; B41J 2/17503
USPC ..... 347/7, 19, 84, 85, 86
See application file for complete search history.

(56) References Cited

U.S. PATENT DOCUMENTS 8,678,567 B2 * 3/2014 Shimizu ..... B41J 2/17523 347/85
2013/0321534 A1 * 12/2013 Ishizawa ..... B65B 3/04 347/85
2015/0109386 A1 * 4/2015 Koike ..... B41J 2/17503 347/86
2015/0210081 A1 * 7/2015 Suzuki ..... B41J 2/175 347/86

FOREIGN PATENT DOCUMENTS

JP 05-131646 A 5/1993
JP 2014-184594 A 10/2014

* cited by examiner

*Primary Examiner* — Jannelle M Lebron
(74) *Attorney, Agent, or Firm* — Global IP Counselors, LLP

(57) ABSTRACT

Provided is a technique for restraining leakage of a liquid from a tank. An ink tank 25 is provided with an ink injecting part 113, an ink container 120, an atmospheric air introduction part 121, and electrode pins 140*a* and 140*b*. A recess 125 that is open downward in the gravity direction when the ink tank 25 is in a posture when ink is supplied to a printing head part 32 is formed in the ink container 120. The electrode pins 140*a* and 140*b* are provided in a first upper wall part 131 constituting an upper end wall part of the recess 125. In addition, an ink injection port 135 of the ink injecting part 113 and an atmospheric air introduction port 136 of the atmospheric air introduction part 121 are provided outside the recess 125, in the ink container 120.

15 Claims, 17 Drawing Sheets

TANK

BACKGROUND

1. Technical Field

The present invention relates to a tank.

2. Related Art

As one aspect of a tank, an ink tank that can store ink to be supplied to a print head part of an inkjet printer (hereinafter simply referred to as "printer") is known. Some ink tanks are configured such that ink can be replenished by a user in the state where the ink tank is mounted to a printer. With such an ink tank, in some cases, an electrode used for detection of an ink residual amount is attached in an ink container in which ink is stored (for example, JP-A-2014-184594). With the ink tank of JP-A-2014-184594, the ink residual amount in the ink container can be electrically detected with a high accuracy. Therefore, it is possible to prompt a user to replenish ink before ink shortage occurs, and occurrence of malfunction such as a printing failure due to ink shortage is restrained.

As in JP-A-2014-184594, in the case where an electrode used for detection of an ink residual amount is held in an ink container, a through hole for arranging a conductive path for the electrode is formed in a wall part of the ink container in some cases. However, it was found, as study of improvement of an ink tank was successively performed, that if a structure for arranging the conductive path such as the through hole as mentioned above is provided in the wall part of the ink container, there is the possibility that the ink leaks out of the ink tank via the structure depending on the use state of the printer.

SUMMARY

An advantage of some aspects of the invention is to solve the above-described problem regarding not only an ink tank but also at least a tank capable of storing a liquid to be supplied to a liquid jetting head, and the invention can be realized as the following modes.

[1] According to one mode of the invention, a tank is provided. This tank may be capable of supplying a liquid to a liquid jetting head that can jet the liquid, and may include a liquid container, a liquid supply part, a liquid injection part, an atmospheric air introduction part, and an electrode part. The liquid container may be able to store the liquid. The liquid supply part may be able to supply the liquid from the liquid container to the liquid jetting head. The liquid injection part may be able to inject the liquid into the liquid container via a liquid injection port that is open in the liquid container. The electrode part (terminal part) may be stored in the liquid container, and be used for detection of the liquid in the liquid container. The liquid container may have a recess constitution wall part in which a recess is formed in the liquid container, the recess being open downward and having blocked upper and lateral sides when the tank is in a liquid supply posture, that is, when the tank is arranged in a posture when the liquid is supplied to the liquid jetting head when jetting the liquid. The electrode part may be provided in the recess constitution wall part. The liquid injection port and the atmospheric air introduction port may be provided in a section excluding the recess, in the liquid container. According to the tank of this mode, when the tank is in the liquid supply posture, it is possible to retain atmospheric air in the recess and restrain intrusion of the liquid into the recess. Therefore, the liquid is restrained from leaking out of the liquid container via a structure for providing the electrode part that is provided in the recess.

[2] In the tank of the above mode, a posture of the tank when the liquid is injected into the liquid container via the liquid injection port may be the same as the liquid supply posture. According to the tank of this mode, also in the case where a liquid is replenished, atmospheric air is retained in the recess, and thus the liquid surface of the liquid is restrained from reaching a through hole in the recess.

[3] In the tank of the above mode, a through hole, which communicates with the outside of the liquid container and in which at least a portion of the electrode part is arranged, may be provided in the recess constitution wall part, and a sealing member for holding the electrode part may be arranged between an inner peripheral surface of the through hole and the electrode part. According to the tank of this mode, airtightness of the liquid container is improved by the sealing member. In addition, because a liquid is restrained from reaching the recess, adhesion of ink to the sealing member is restrained, and deterioration of the sealing member is restrained. Therefore, leakage of the ink due to the deterioration of the sealing member is restrained.

[4] In the tank of the above mode, the liquid container may have an upper wall part that is positioned above the liquid container and extends in a direction intersecting the gravity direction when the tank is in the liquid supply posture, and the upper wall part may include at least: a first upper wall part that, when the tank is in the liquid supply posture, extends in a direction intersecting the gravity direction and is positioned, as a portion of the recess constitution wall part, above a space in the recess; a sidewall part that extends downward from the first upper wall part and is positioned, as a portion of the recess constitution wall part, lateral to the space in the recess when the tank is in the liquid supply posture; and a second upper wall part that is at a position lower than the first upper wall part and extends from the sidewall part in a direction that intersects the gravity direction and is a direction of separating from the recess when the tank is in the liquid supply posture. According to the tank of this mode, the recess is arranged at a position above the liquid container when the tank is in the liquid supply posture, and thus ink is restrained from reaching the through hole in the recess. In addition, also due to the second upper wall part that is at a position lower than the first upper wall part in the recess, ink is restrained from reaching the through hole in the recess.

[5] In the tank of the above mode, the upper wall part may further include: a third upper wall part that is positioned at a position higher than the second upper wall part and extends in a direction intersecting the gravity direction when the tank is in the liquid supply posture, the third upper wall part may be on an opposite side to the first upper wall part and sandwich the sidewall part and the second upper wall part with the first upper wall part, and the liquid injection port and the atmospheric air introduction port may be formed so as to be open toward a region positioned below the third upper wall part when the tank is in the liquid supply posture. According to the tank of this mode, the liquid injection port and the atmospheric air introduction port sandwich the sidewall part and the second upper wall part and are formed at positions spaced apart from the recess, and therefore atmospheric air retentivity in the recess is further improved, and intrusion of the ink into the recess is further restrained.

[6] In the tank of the above mode, the liquid container may include: an upper wall part that is positioned above the liquid container and extends in a direction intersecting the gravity direction when the tank is in the liquid supply posture; a bottom wall part that is positioned below the liquid container, faces the upper wall part, and extends in a direction intersecting the gravity direction when the tank is in the liquid supply posture; and a partition wall part that extends from the upper wall part to a position between the upper wall part and the bottom wall part so as to partition a space in the liquid container, and the partition wall part may be positioned, as a portion of the recess constitution wall part, lateral to a space in the recess. According to the tank of this mode, the recess can be easily formed in the liquid container using the partition wall part.

[7] In the tank of the above mode, the tank may further include: a case member, which is a box body that is open in one direction; and a sheet member that is joined to the case member so as to be capable of sealing the opening of the case member, wherein the liquid container may be positioned between the case member and the sheet member, and an inner wall surface of the recess may be constituted by the inner wall surface of the case member and the surface of the sheet member. According to the tank of this mode, simplification, miniaturization and weight reduction of the configuration is possible.

[8] In the tank of the above mode, a sidewall of the recess, which is a portion of the recess constitution wall part, may be constituted by a wall part of a cylindrical part protruding outward of the liquid container. According to the tank of this mode, the recess is formed at a section protruding from the liquid container, and thus intrusion of a liquid into the recess is further restrained.

[9] In the tank of the above mode, the electrode part may be provided in an upper end wall part positioned on the upper side in the recess when the tank is in the liquid supply posture. According to the tank of this mode, a liquid is further restrained from reaching a section having the structure for arranging the electrode part.

[10] In the tank of the above mode, the electrode part may be provided in a sidewall of the recess. According to the tank of this mode, the electrode part can be arranged in a wall part positioned in a direction intersecting the gravity direction when the tank is in the liquid supply posture.

[11] In the tank of the above mode, the electrode part may be provided at a position higher than the liquid injection port in the recess when the tank is in the liquid supply posture. According to the tank of this mode, a liquid from the liquid injection port is restrained from reaching a section in which the electrode part is provided.

[12] In the tank of the above mode, the liquid injection part may include a liquid intake port that is open outward of the tank, and the electrode part may be provided at a position higher than the liquid intake port in the recess constitution wall part when the tank is in the liquid supply posture. According to the tank of this mode, outside the tank, a liquid from the liquid intake port is restrained from reaching the section having the structure for providing the electrode part. Therefore, the liquid is restrained from coming into contact with an unexpected section of the electrode part, and deterioration of the electrode part, decline in detection accuracy of the liquid and the like are restrained.

[13] Furthermore, the tank of the above mode may further include: a first sidewall part and a second sidewall part that face each other and sandwich the liquid container in a direction intersecting the gravity direction when the tank is in the liquid supply posture, wherein the liquid injection port may be positioned between the first sidewall part side and a center between the first sidewall part and the second sidewall part in a direction from the first sidewall part to the second sidewall part, and the electrode may be provided in the recess constitution wall part between the second sidewall part side and the center between the first sidewall part and the second sidewall part. According to the tank of this mode, the liquid injection port and the section of the recess constitution wall part in which the electrode part is provided are arranged at positions that are spaced apart from each other, and thus a liquid from the liquid injection port is restrained from reaching the section.

[14] In the tank of the above mode, at least a portion of the atmospheric air introduction part may be positioned, in the direction from the first sidewall part toward the second sidewall part, between the liquid injection part and the section in the recess constitution wall part in which the electrode part is provided, and may protrude above the liquid injection part and the section in the recess constitution wall part in which the electrode part is provided when the tank is in the liquid supply posture. According to the tank of this mode, due to the atmospheric air introduction part that protrudes upward, a liquid from the liquid injection is restrained from reaching the section in which the electrode part is provided, outside the tank.

Not all of the constituent components provided in the above-described modes of the invention are essential, and some of the constituent components may be modified, deleted, or replaced with a new constituent component, or the content of limitation may be partially deleted as appropriate, in order to solve a part of or the entire problem described above, or to achieve some or all of the effects described in this specification. It is also possible to combine some or all of the technical features included in one of the above-described modes of the invention with some or all of the technical features included in another one of the above-described modes of the invention to make an independent mode of the invention, in order to solve a part of or the entire problem described above, or to achieve some or all of the effects described in the specification.

The invention can also be achieved in various modes other than a tank that can supply a liquid to a liquid jetting head. For example, the invention can be achieved as a tank unit provided with a tank, or a liquid jetting system. In addition, the invention can also be achieved as a tank that can supply a liquid to an apparatus other than the liquid jetting head, or a tank unit or a system provided with the tank. Note that in this specification, "system" refers to a group of constituent elements that are compositely combined in an integral or distributed state, such that the functions of the constituent elements are related to one another directly or indirectly, in order to achieve one or more functions. Therefore, the system in this specification also includes an "apparatus" in which a plurality of constituent elements are integrally combined.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Configuration of Printer

Figure 1:
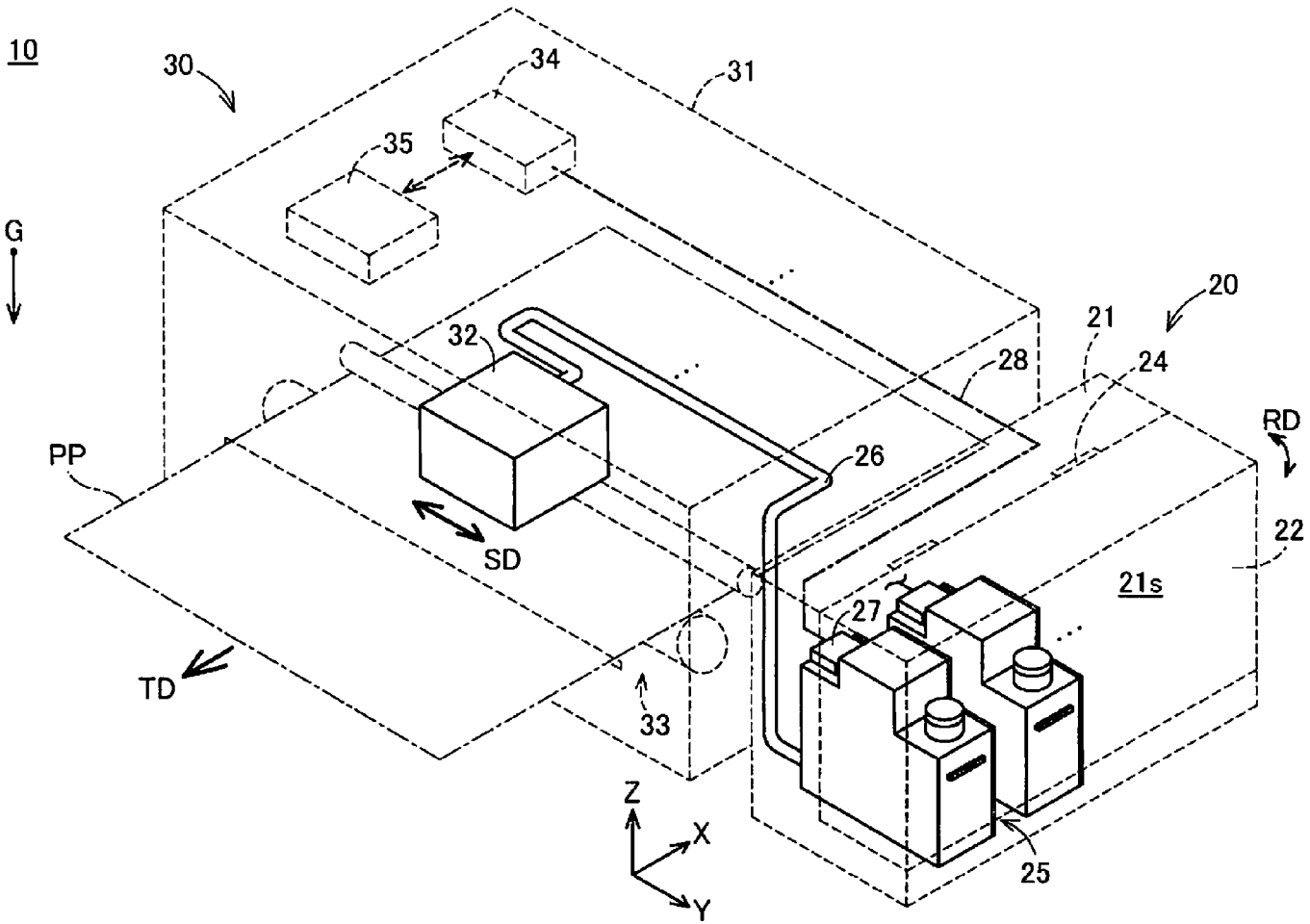
FIG. 1 is a schematic diagram showing a configuration of an inkjet printer.

FIG. 1 is a schematic diagram showing the configuration of an inkjet printer 10 (hereinafter simply referred to as "printer 10") that is provided with ink tanks 25 as the first embodiment of the invention. In FIG. 1, an arrow G indicating the gravity direction when the printer 10 is in a normal use state is illustrated. In this specification, "upper/upward/above" and "lower/downward/below" mean the up-down direction based on the gravity direction unless especially stated otherwise. In addition, in FIG. 1, arrows X, Y and Z indicating three directions that are based on the ink tank 25 and orthogonally intersect one another are illustrated. The directions indicated by the arrows X, Y and Z will be described later. Arrows G, X, Y and Z are also appropriately illustrated in the drawings referred to in the following description.

The printer 10 is one aspect of the liquid jetting system, and forms an image on a printing side of printing paper PP by discharging ink droplets onto the printing paper PP, which is a printing medium. The printer 10 is provided with a tank unit 20 and a printing part 30. The tank unit 20 is provided with a casing part 21, a plurality of the ink tanks 25, a plurality of tubes 26, a plurality of circuit units 27, and a plurality of signal lines 28 (indicated by dashed-dotted lines).

The ink tank 25 corresponds to a subordinate concept of the tank in the invention. Ink of a different color is stored in each of the ink tanks 25. The ink stored in the ink tanks 25 is supplied to a printing head part 32 of the printing part 30 via the tubes 26 that are made of resin having flexibility and are connected to the ink tanks 25 one by one.

Electrode pins (not illustrated) used for detecting the stored ink are attached to the ink tanks 25, and the electrode pins are electrically connected to the circuit units 27. The circuit units 27 are electrically connected to an ink detection part 34 of the printing part 30 via the signal lines 28, and mediate the electric connection between the electrode pins and the ink detection part 34. The configuration of the ink tank 25, and the electrode pins will be described later.

In the tank unit 20, the ink tanks 25 are fixed to an internal space 21*s* of the casing part 21 in the state where the ink tanks 25 are aligned in a line in a width direction indicated by the arrow X (to be described later). The casing part 21 is provided with a lid part 22. The lid part 22 is coupled to a main body of the casing part 21 using a hinge mechanism 24, and is open and closes by rotating in a direction indicated by an arrow RD. By the user of the printer 10 opening the lid part 22, various operations for the ink tanks 25 become possible. Note that the casing part 21 does not need to be constituted to be capable of opening and closing by rotation of the lid part 22, and may be constituted to be capable of opening and closing by attaching or detaching of the lid part 22, for example. In addition, the lid part 22 may be equipped with a window part that enables visual recognition of the ink tanks 25 from outside without opening or closing the lid part 22, a window part that allows the ink tanks 25 to be replenished with ink, or the like.

The printing part 30 corresponds to a subordinate concept of a liquid jetting apparatus, and is provided with a casing part 31, the printing head part 32, a conveyance mechanism 33 for the printing paper PP, the ink detection part 34, and a control unit 35. The casing part 31 is an exterior part of the printing part 30, and has the control unit 35, the printing head part 32, and the conveyance mechanism 33 stored therein.

The printing head part 32 is installed so as to be reciprocably movable in a main scanning direction SD on a conveyance path for the printing paper PP. The printing head part 32 is connected to the ink tanks 25 of the tank unit 20 via the above plurality of tubes 26. The printing head part 32 can jet ink supplied from the ink tanks 25 under the control by the control unit 35. The printing head part 32 corresponds to a subordinate concept of the liquid jetting head of the invention. The conveyance mechanism 33 can convey the printing paper PP in a conveyance direction TD intersecting the main scanning direction SD by rotationally driving a conveyance roller.

As described above, the ink detection part 34 is electrically connected to the electrode pins of the ink tanks 25 via the signal lines 28 and the circuit units 27. The ink detection part 34 periodically applies a current for detecting ink in the ink tanks 25 to the electrode pins of the ink tanks 25 via the signal lines 28, and detects change in resistance. The ink detection part 34 transmits a detection result to the control unit 35.

For example, the control unit 35 is constituted by a microcomputer provided with a central processing apparatus and a main storage apparatus. The control unit 35 executes various functions by the central processing apparatus loading various programs to the main storage apparatus and executing the programs. In this embodiment, the control unit 35 functions as a printing processing part for controlling the printing part 30 based on printing data input from outside and executing printing processing. In the printing processing, the conveyance mechanism 33 conveys the printing paper PP, and the printing head part 32 discharges ink droplets while reciprocally moving in the main scanning direction SD, whereby a print image is formed on the printing side of the printing paper PP.

In addition, in this embodiment, the control unit 35 also functions as an ink residual amount management unit for detecting whether or not ink of a predetermined amount or more is stored in each of the ink tanks 25 based on the change in resistance detected by the ink detection part 34. In the case where it is detected that the ink residual amount in the ink tanks 25 became lower than the predetermined amount, the control unit 35 executes informing processing of informing the user that a replenishment time has come, for example. In addition, the control unit 35 may start measuring the remaining number of times that ink droplets can be discharged by the printing head part 32.

In this embodiment, the casing part 21 of the tank unit 20 and the casing part 31 of the printing part 30 are coupled in a detachable and rotatable state (not illustrated). In this manner, the tank unit 20 and the printing part 30 are constituted as separate bodies, and thereby maintenance can be independently performed on the tank unit 20 and the printing part 30, and maintainability of the printer 10 is enhanced. In addition, due to the tank unit 20 and the printing part 30 being coupled, moving and installing the printer 10 becomes easy. However, the tank unit 20 and the printing part 30 do not need to be coupled.

Configuration of Ink Tank

Figure 2:
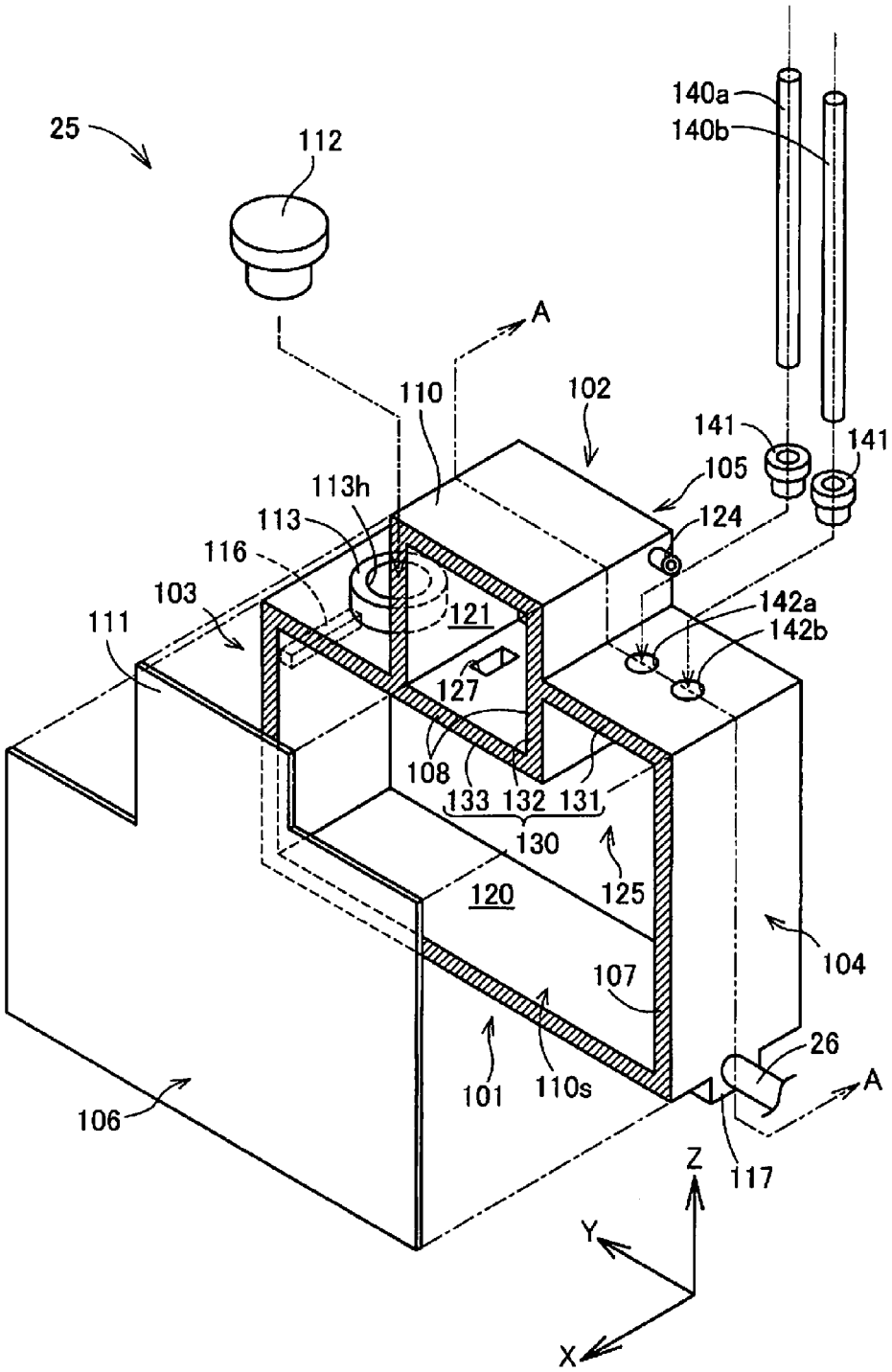
FIG. 2 is a schematic exploded perspective diagram of an ink tank.
Figure 3:
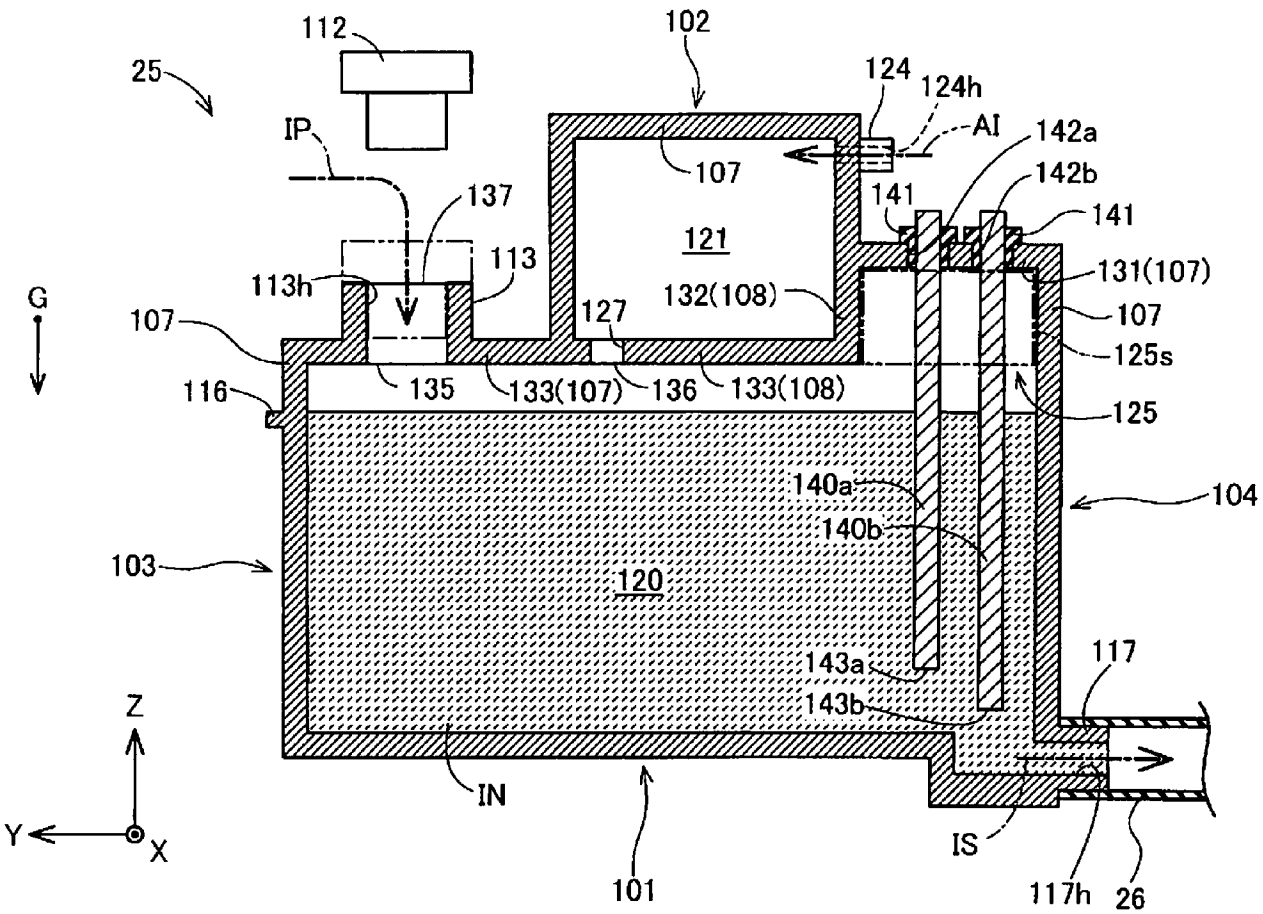
FIG. 3 is a schematic cross-sectional diagram of an ink tank.
Figure 4:
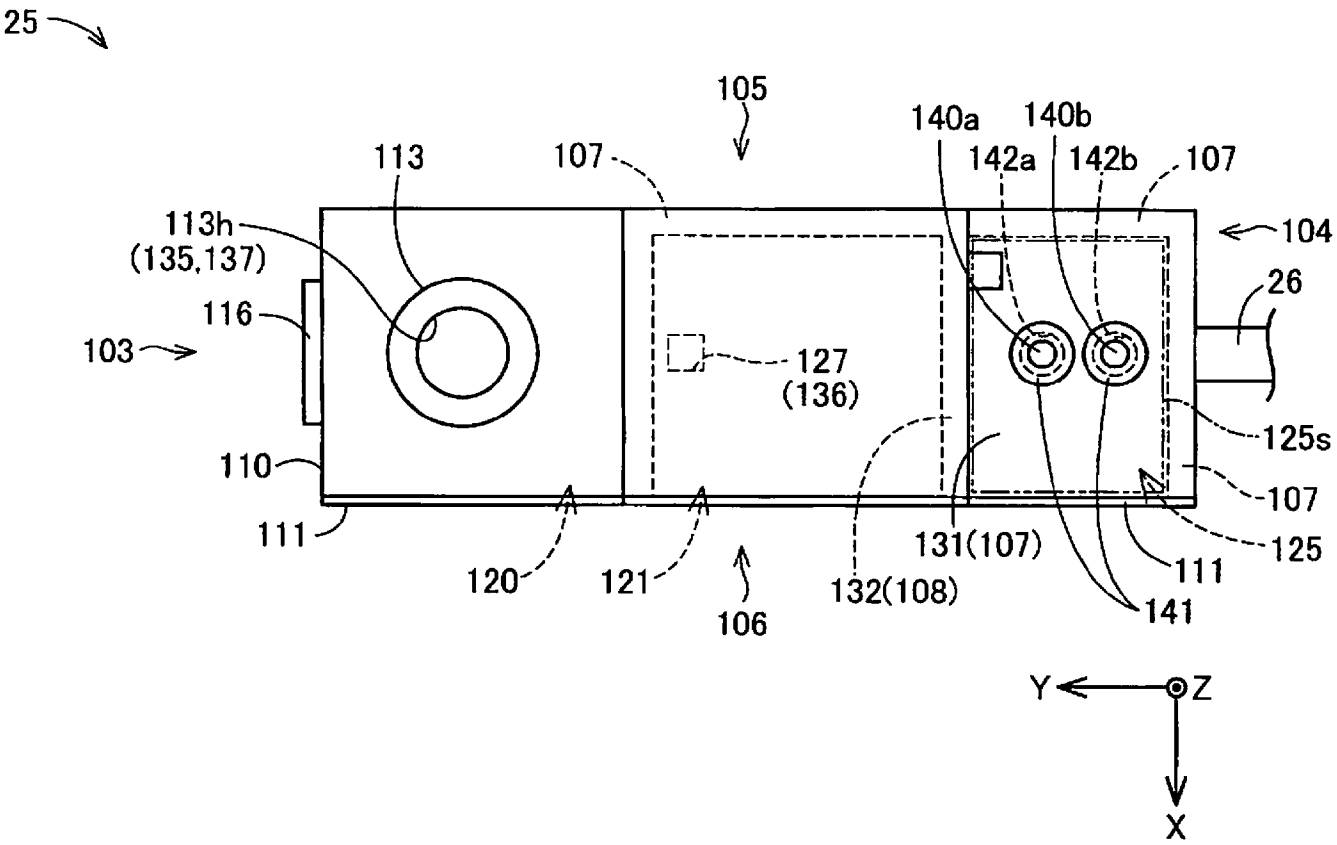
FIG. 4 is a schematic top view diagram of an ink tank.

The configuration of the ink tank 25 will be described with reference to FIGS. 2 to 4 in addition to FIG. 1. FIG. 2 is a schematic exploded perspective diagram of the ink tank 25. FIG. 3 is a schematic cross-sectional diagram of the ink tank 25 in a cross section taken along A-A shown in FIG. 2. In FIG. 3, a state in which ink IN is stored in an ink container 120, and a cap member 112 has been removed from an ink injecting part 113 is schematically illustrated. FIG. 4 is a schematic top view diagram of the ink tank 25 when viewed in a direction from a second face part 102 to a first face part 101. In FIG. 4, portions of an internal structure are illustrated by broken lines.

The ink tank 25 is constituted as a hollow container having six face parts 101 to 106 (FIG. 2). The six face parts 101 to 106 will be described based on a posture when the ink tank 25 is mounted to the tank unit 20 (FIG. 1). In the following description, this posture is referred to as "reference posture". In this embodiment, the posture of the ink tank 25 when ink is supplied to the printing head part 32 when jetting the ink is the same as the reference posture. That is, the reference posture corresponds to one aspect of the liquid supply posture of the invention. In addition, in this embodiment, the posture of the ink tank 25 when ink is replenished to the ink tank 25 by a user is also the same as the reference posture.

In the ink tank 25, the first face part 101 constitutes a bottom face part directed downward, and the second face part 102 constitutes a top face part directed upward (FIGS. 1 and 2). A third face part 103 intersects the first face part 101 and the second face part 102, and constitutes a front face part that faces the user when the lid part 22 of the casing part 21 is opened in the tank unit 20. An outer wall part 107 constituting the third face part 103 corresponds to a subordinate concept of the first sidewall part in the invention. A fourth face part 104 intersects the first face part 101 and the second face part 102, and constitutes a back face part that is directed in a direction opposite to the third face part 103. The outer wall part 107 constituting the fourth face part 104 corresponds to a subordinate concept of the second sidewall part in the invention. The fifth face part 105 intersects the above four face parts 101 to 104, and constitutes a left face part that is positioned on the left side in the front view of the third face part 103. A sixth face part 106 intersects four face parts 101 to 104, and constitutes a right face part that is positioned on the right side, which is an opposite side to the third face part 103, in the front view of the third face part 103. Note that in this specification, "two face parts intersect" means one of a state in which two face parts actually intersect each other, a state in which an extension plane of one of the face parts intersects another face part, and a state in which extension planes of two face parts intersect each other.

Next, the arrows X, Y and Z indicating the three directions that are based on the ink tank 25 will be described. The arrow X indicates a direction parallel to the width direction of the ink tank 25 (right-left direction), and indicates a direction from the fifth face part 105 toward the sixth face part 106. In the following description, "right" means a side in the direction of the arrow X, and "left" means a side in a direction opposite to the direction of the arrow X. The arrow Y indicates a direction parallel to the depth direction of the ink tank 25 (front-back direction), and indicates a direction from the fourth face part 104 toward the third face part 103. In the following description, "front" means a side in the direction of the arrow Y, and "back" means a side in a direction opposite to the direction of the arrow Y. The arrow Z indicates the height direction (up-down direction) of the ink tank 25, and indicates a direction from the first face part 101 toward the second face part 102. When the ink tank 25 is in the reference posture, the arrow Z is directed in a direction opposite to the gravity direction.

The ink tank 25 is provided with a case member 110, a sheet member 111, the cap member 112, a pair of electrode pins 140*a* and 140*b*, and two sealing members 141 (FIG. 2). The case member 110 is a hollow box body that constitutes the body portion of the ink tank 25. The entirety of the sixth face part 106 side of the case member 110 is open in the direction of the arrow X, and the outer wall part 107 surrounding an internal space 110*s* of the case member 110 constitutes five face parts 101 to 105 excluding the sixth face part 106. The case member 110 is produced by being integrally molded from synthetic resin such as nylon or polypropylene.

The sheet member 111 is a thin film-like member having flexibility, is joined so as to seal the entirety of the opening of the case member 110, and constitutes the sixth face part 106 of the ink tank 25 (FIGS. 2 and 4). The sheet member 111 is constituted by a film member formed of synthetic resin such as nylon or polypropylene. The sheet member 111 is joined to the case member 110 by welding, for example. In this manner, the body portion of the ink tank 25 of this embodiment is constituted by the case member 110 and the sheet member 111 so as to be simple and lightweight. Note that the fifth face part 105 side of the ink tank 25 may also be constituted by a sheet member joined to the case member 110 similarly to the sixth face part 106 side.

In the ink tank 25, the internal space 110*s* of the case member 110 is provided with inner wall part 108 (FIGS. 2 and 3). The inner wall part 108 has substantially the same height in the direction of the arrow X as the outer wall part 107, and is welded to the sheet member 111 along with the outer wall part 107. The internal space 110*s* surrounded by the case member 110 and the sheet member 111 is partitioned by the inner wall part 108 into the ink container 120 below and an atmospheric air introduction part 121 above.

The ink container 120 is a hollow section capable of storing the ink IN, and corresponds to a subordinate concept of the liquid container in the invention. In this embodiment, the ink container 120 is formed over the entirety of the ink tank 25 in the width direction and the front-back direction (FIGS. 3 and 4). The atmospheric air introduction part 121 is a hollow section capable of storing atmospheric air (air) introduced from outside the ink tank 25 into the ink container 120. The atmospheric air introduction part 121 is provided in an intermediate local range in the front-back direction of the ink tank 25. In this embodiment, the atmospheric air introduction part 121 protrudes upward approximately at a center of the ink tank 25 in the front-back direction. Accordingly, for example, even in the case where the ink tank 25 falls by mistake with the second face part 102 side down, the ink injecting part 113 and the electrode pins 140*a* and 140*b* to be described later are protected by the outer wall part 107 surrounding the atmospheric air introduction part 121.

Here, among the wall parts constituting the ink container 120, a wall part extending in a direction intersecting the gravity direction above the ink container 120 is referred to as "upper wall part 130" (FIG. 2). In this specification, "extend" means a state of continuously extending in a predetermined direction, and there may be a bending portion or a curved portion midway in the extending. In addition, a through hole, an uneven shape or the like may be formed. The upper wall part 130 has a first upper wall part 131, a sidewall part 132, and a second upper wall part 133.

The first upper wall part 131 is constituted, at a position on the fourth face part 104 side relative to the atmospheric air introduction part 121, by the outer wall part 107 extending in the direction of the arrow Y (FIG. 3). The sidewall part 132 is constituted, laterally to the atmospheric air introduction part 121, by the inner wall part 108 extending downward from the end of the first upper wall part 131 on the third face part 103 side. The second upper wall part 133 is bent from the sidewall part 132 and extends horizontally in the direction of the arrow Y. The second upper wall part 133 is constituted by the inner wall part 108 positioned below the atmospheric air introduction part 121, and the outer wall part 107 positioned on the third face part 103 side relative to the atmospheric air introduction part 121 and extending in the direction of the arrow Y.

In this manner, in the upper wall part 130 of the ink container 120, the first upper wall part 131 is positioned at a position higher than the second upper wall part 133, the first upper wall part 131 and the second upper wall part 133 sandwiching a level difference formed by the sidewall part 132. Accordingly, a recess 125 that is open downward in the gravity direction is formed above the ink container 120 on the fourth face part 104 side (FIGS. 2 and 3). In the recess 125, an upper wall part blocking the upper side (of the recess 125) is constituted by the first upper wall part 131, and a sidewall part blocking the lateral sides of the recess 125 is constituted by the sidewall part 132, the outer wall part 107 and the sheet member 111 that are arranged on the periphery of the first upper wall part 131 (FIGS. 3, and 4). In this specification, "lateral side" of the recess means a direction intersecting a direction from the opening of the recess toward an end located in the farmost position of the recess. Note that in FIGS. 3 and 4, the region of a recess space 120*s*, which is a space in the recess 125, is illustrated with a dashed double-dotted line. The functions of the recess 125 in the ink tank 25 will be described later. Note that in this embodiment, the above-described wall parts 131, 132, 107 and 111 constituting the recess 125 correspond to a subordinate concept of the recess constitution wall part in the invention.

The second upper wall part 133 of the ink container 120 is provided with the ink injecting part 113 (FIGS. 3 and 4). The ink injecting part 113 is a section that allows the ink container 120 to communicate with the outside so that the ink IN can be injected into the ink container 120. The ink injecting part 113 corresponds to a subordinate concept of the liquid injection part in the invention. In this embodiment, the ink injecting part 113 is constituted as a cylindrical section having a through hole 113*h* that communicates with the ink container 120, and protrudes upward from the second upper wall part 133.

An ink injection port 135 is open at a section in which the through hole 113*h* of the ink injecting part 113 and the ink container 120 intersect. The ink injection port 135 is open in the second upper wall part 133, and is positioned in a region outside the recess 125. The ink injection port 135 corresponds to a subordinate concept of the liquid injection port in the invention. An ink intake port 137 is open in the top end face of the ink injecting part 113. The ink intake port 137 corresponds to a subordinate concept of the liquid intake port in the invention.

Usually, the cap member 112 is attached to the upper end of the ink injecting part 113 in an airtight manner (FIG. 3). The cap member 112 is inserted into the through hole 113*h* of the ink injecting part 113, and has a section that tightly adheres to the inner wall surface of the through hole 113*h*. The cap member 112 is made of synthetic resin such as nylon or polypropylene. A user can replenish the ink container 120 with the ink IN as indicated by an arrow IP by removing the cap member 112 from the ink injecting part 113. Note that in this embodiment, the ink injecting part 113 is formed at a position in the second face part 102 on the third face part 103 side that is closer to the third face part 103 than the fourth face part 104. Therefore, when the ink tank 25 is mounted to the ink tank unit 20, the user can easily access the ink injecting part 113.

An ink supply part 117 is formed at the lower end of the ink container 120 on the fourth face part 104 side (FIG. 3). The ink supply part 117 is a section that allows the ink container 120 to communicate with the outside such that the ink IN of the ink container 120 can be supplied to the printing head part 32 (FIG. 1). In this embodiment, the ink supply part 117 is constituted as a cylindrical section having a through hole 117*h* that communicates with the lower end of the ink container 120, and protrudes backward from the outer wall part 107 of the case member 110 at the lower end of the fourth face part 104. The tube 26 connected to the printing head part 32 is connected to the ink supply part 117 in an airtight manner. Note that the ink supply part 117 may have a configuration in which the ink supply part 117 extends upward from the fourth face part 104 on the lower end side, and a mounting direction of the tube 26 is a direction opposite to the direction of the arrow Z.

The atmospheric air introduction part 121 communicates with the outside of the ink tank 25 via an atmospheric air intake part 124 (FIG. 3). The atmospheric air introduction part 121 intakes external atmospheric air from the atmospheric air intake part 124, as indicated by an arrow AI. In this embodiment, the atmospheric air intake part 124 is constituted as a cylindrical section having a through hole 124*h* communicating with the ink container 120, and is provided in the outer wall part 107 of the atmospheric air introduction part 121 on the fourth face part 104 side. The atmospheric air intake part 124 may be provided in another section, and may be formed in the outer wall part 107 that is positioned above the atmospheric air introduction part 121 and constitutes the second face part 102, for example.

In the inner wall part 108 constituting the second upper wall part 133 between the ink container 120 and the atmospheric air introduction part 121, a communication path 127 is formed as a through hole passing through the inner wall part 108 (FIGS. 2 and 3). Atmospheric air stored in the atmospheric air introduction part 121 is introduced into the ink container 120 via the communication path 127. An atmospheric air introduction port 136 is open in a section in which the communication path 127 of the atmospheric air introduction part 121 intersects the ink container 120 (FIG. 3). That is, the atmospheric air introduction port 136 is open in the second upper wall part 133, and is positioned in a region outside of the recess 125. In the ink tank 25, when the ink IN in the ink container 120 is consumed (arrow IS), the pressure in the ink container 120 becomes negative, and atmospheric air is introduced into the ink container 120 from the atmospheric air introduction part 121 via the atmospheric air introduction port 136.

In the case member 110 of this embodiment, at least a part of or the whole wall part of the third face part 103 is constituted so as to be transparent or translucent such that a user can visually recognize the liquid surface of the ink IN in the ink container 120. Thereby, the user can visually recognize the amount of ink stored in the ink tank 25 when replenishing the ink tank 25 with the ink IN or the like.

In the wall face of the third face part 103, a mark part 116 is provided at a position lower than the upper wall face of the ink container 120 constituted by the second upper wall part 133 (FIGS. 2 and 3). The mark part 116 is formed so as to indicate the position of the liquid surface of the ink IN when the ink IN of a predetermined reference amount is stored in the ink tank 25 that is in the reference posture. In the ink tank 25, the maximum amount (reference amount) of the ink IN to be stored in the ink tank 25 is specified by the indication of the mark part 116. The mark part 116 may be formed as a projection or a recess in the wall face of the third face part 103, or may be formed by printing or attaching a sticker, for example.

In the ink tank 25 of this embodiment, a pair of electrode pins 140*a* and 140*b* are attached to the first upper wall part 131 of the ink container 120 (FIGS. 2 and 3). The electrode pins 140*a* and 140*b* are constituted by conductive members extending in a bar-like shape. Two through holes 142*a* and 142*b* for inserting the electrode pins 140*a* and 140*b* are provided in the first upper wall part 131.

The first electrode pin 140*a* is inserted into a first through hole 142*a*, and the second electrode pin 140*b* is inserted into a second through hole 142*b*. The cylindrical sealing members 141 are respectively embedded between the inner peripheral surface of the first through hole 142*a* and the first electrode pin 140*a*, and between the inner peripheral surface of the second through hole 142*b* and the second electrode pin 140*b*. Accordingly, fixability of the electrode pins 140*a* and 140*b* is enhanced, and airtightness of the ink container 120 is also enhanced.

The electrode pins 140*a* and 140*b* extend from the recess 125 that has been formed in the ink container 120 to a position short of the bottom face of the ink container 120 (FIG. 3). The electrode pins 140*a* and 140*b* correspond to a subordinate concept of the electrode part of the invention. In addition, a section in the ink container 120 in which openings of the through holes 142*a* and 142*b* are formed corresponds to a subordinate concept of the section in the recess constitution wall part in which the electrode part is provided in the invention.

Top ends 143*a* and 143*b* of the electrode pins 140*a* and 140*b* are positioned, in the height direction, between the lower end of the ink container 120 and an intermediate position between the upper end and the lower end of the ink container 120 in the height direction. In this embodiment, the top end 143*a* of the first electrode pin 140*a* is positioned at a higher position than the top end 143*b* of the second electrode pin 140*b*. The top end 143*a* of the first electrode pin 140*a* may be positioned at a position at substantially the same height as the position of the top end 143*b* of the second electrode pin 140*b*.

In the printer 10 (FIG. 1), the electrode pins 140*a* and 140*b* are connected to the ink detection part 34 via the circuit units 27. When printing processing is being executed or printing processing has been suspended, the ink detection part 34 periodically applies a current to the first electrode pin 140*a*, and detects resistance between the first electrode pin 140*a* and the second electrode pin 140*b*. The resistance between the two electrode pins 140*a* and 140*b* increases when the ink IN in the ink container 120 is consumed, the liquid surface thereof descends to a position that is lower than the top end 143*a* of the first electrode pin 140*a*, and an electrical continuity between the ink IN and the first electrode pin 140*a* is shut off. When the resistance detected by the ink detection part 34 increases to a predetermined threshold or higher, the control unit 35 detects that the ink amount in the ink container 120 has fallen below a specified amount. Note that the ink detection part 34 may apply a current for detection of the ink IN to the second electrode pin 140*b* instead of the first electrode pin 140*a*. In addition, the control unit 35 may detect, as change in ink amount of the ink container 120, change in resistance that corresponds to change in contact area of the electrode pins 140*a* and 140*b* with the ink IN.

Here, as described above, in the ink tank 25 of this embodiment, the electrode pins 140*a* and 140*b* are attached in the through holes 142*a* and 142*b* provided in the first upper wall part 131 that constitutes the upper end wall part of the recess 125 in the ink container 120 (FIG. 3). In addition, the ink injection port 135 and the atmospheric air introduction port 136 that can be an atmospheric passage to the ink container 120 are provided outside the recess 125 (FIG. 4), and in the recess 125, there is no outlet that allows atmospheric air to flow out. Thus, for example, even in the case where the printer 10 as well as the ink tanks 25 are arranged to be inclined with respect to a horizontal plane, atmospheric air is retained in the recess space 120*s*, and the ink IN is restrained from reaching the through holes 142*a* and 142*b*. Similarly, even in the case where the ink IN is excessively replenished by the user, the liquid surface of the ink IN is restrained from reaching the recess 125 by atmospheric air retained in the recess 125. Therefore, the ink IN is restrained from leaking to the outside of the ink tank 25 via the through holes 142*a* and 142*b*.

In the ink tank 25 of this embodiment, the sealing members 141 are arranged in the through holes 142*a* and 142*b*. With the ink tank 25 of this embodiment, as mentioned above, the ink IN is restrained from reaching a far position in the recess 125, and thus the ink IN is restrained from adhering to the sealing members 141. Therefore, deterioration of the sealing members 141 due to adhesion of the ink IN is restrained, and malfunctions such as decline in airtightness of the ink container 120, decline in fixability of the electrode pins 140*a* and 140*b*, and leakage of the ink IN due to the deterioration of the sealing members 141 are restrained.

In addition, in this embodiment, the recess 125 is formed at a position of protruding above the ink container 120 (FIG. 3). Thus, the ink IN is unlikely to reach the recess 125, and intrusion of the ink IN into the recess 125 is further restrained. In addition, with the ink tank 25 of this embodiment, the second upper wall part 133 whose height position is lower than the first upper wall part 131 is provided in the upper wall part 130 of the ink container 120 in order to form the recess 125. When a user replenishes the ink tank 25 with the ink IN, it is possible to allow the user to recognize the wall face position of the second upper wall part 133 as the upper limit position of the ink IN in the ink container 120. Therefore, the ink container 120 being replenished with an excessive amount of the ink IN is restrained. In this embodiment, because the mark part 116 is formed in the third face part 103, the liquid surface of the ink IN is further restrained from reaching the recess 125.

In the ink tank 25 of this embodiment, the through holes 142*a* and 142*b* are formed in the first upper wall part 131, which is a blocked end of the recess 125 (FIG. 3). Even if a portion of the ink IN has reached the wall face of the first upper wall part 131 due to flying or the like, the ink IN is subjected to an external force in a direction of falling from the first upper wall part 131 due to gravity. Therefore, even in the case where the ink IN has reached the wall face of the first upper wall part 131, leakage of the ink IN from the through holes 142*a* and 142*b*, deterioration of the sealing members 141 due to adhesion of the ink IN, and the like are restrained.

In the ink tank 25 of this embodiment, the through holes 142*a* and 142*b* are at a position higher than the ink injection port 135 (FIG. 3). Accordingly, the ink IN is restrained from reaching the through holes 142*a* and 142*b* from the ink injection port 135, and the ink IN being injected from the ink injection port 135 is restrained from flying to the through holes 142*a* and 142*b*.

Furthermore, in the ink tank 25 of this embodiment, the ink injection port 135 is on the third face part 103 side, and the through holes 142*a* and 142*b* are on the fourth face part 104 side, in the ink container 120. More specifically, the ink injection port 135 is positioned between the outer wall part 107 constituting the third face part 103, and an intermediate position between the outer wall part 107 constituting the third face part 103 and the outer wall part 107 constituting the fourth face part 104, in the front-back direction. In addition, the through holes 142*a* and 142*b* are positioned between the outer wall part 107 constituting the fourth face part 104, and an intermediate position between the outer wall part 107 constituting the third face part 103 and the outer wall part 107 constituting the fourth face part 104.

In this manner, in the ink tank 25 of this embodiment, the ink injecting part 113 and the through holes 142*a* and 142*b* are formed at positions that are spaced apart in the front-back direction, in the ink container 120. Thus, the ink IN is further restrained from reaching the through holes 142*a* and 142*b* from the ink injection port 135. Note that it is sufficient that a forming position of the ink injection port 135 is between the outer wall part 107 constituting the third face part 103, and an intermediate position between the outer wall part 107 constituting the third face part 103 and the outer wall part 107 constituting the fourth face part 104, and the forming position of the ink injection port 135 is not limited to a center position between the outer wall part 107 constituting the third face part 103 and the outer wall part 107 constituting the fourth face part 104 or the like. This can be applied to forming positions of the through holes 142*a* and 142*b*.

In the ink tank 25 of this embodiment, the electrode pins 140*a* and 140*b* extend in the gravity direction (FIG. 3). Thus, the ink IN that adhered to the electrode pins 140*a* and 140*b* above the liquid surface of the ink IN is guided downward due to gravity. Therefore, a state in which excessive ink IN adheres to the electrode pins 140*a* and 140*b* is restrained, and decline in ink IN detection accuracy due to such adhesion of the ink IN is restrained.

Additionally, in the ink tank 25 of this embodiment, the ink intake port 137 of the ink injecting part 113 is at a position higher than the through holes 142*a* and 142*b* (FIG. 3). Therefore, when the ink IN is replenished via the ink intake port 137, ink droplets that flew out of the ink tank 25 are restrained from reaching the through holes 142*a* and 142*b*. Therefore, deterioration of the sealing members 141 due to adhesion of ink droplets, decline in ink detection accuracy due to a cause such as short-circuiting between the electrode pins 140*a* and 140*b*, and the like are restrained. In particular, in the ink tank 25 of this embodiment, the atmospheric air introduction part 121 protrudes upward above the ink intake port 137 between the ink injecting part 113 and the through holes 142*a* and 142*b*. Thus, a forming section of the atmospheric air introduction part 121 functions as a partition wall between the ink injecting part 113 and the through holes 142*a* and 142*b*, and ink droplets are further restrained from flying from the ink injecting part 113 to the through holes 142*a* and 142*b* outside the ink tanks 25.

Summery

As described above, according to the ink tank 25 of the first embodiment, the through holes 142*a* and 142*b* for the electrode pins 140*a* and 140*b* are formed in the recess 125, and thereby leakage of ink from the through holes 142*a* and 142*b* is restrained. Additionally, according to the ink tank 25 of the first embodiment, it is possible to exhibit the various actions and effects described above.

B. Second Embodiment

Figure 5:
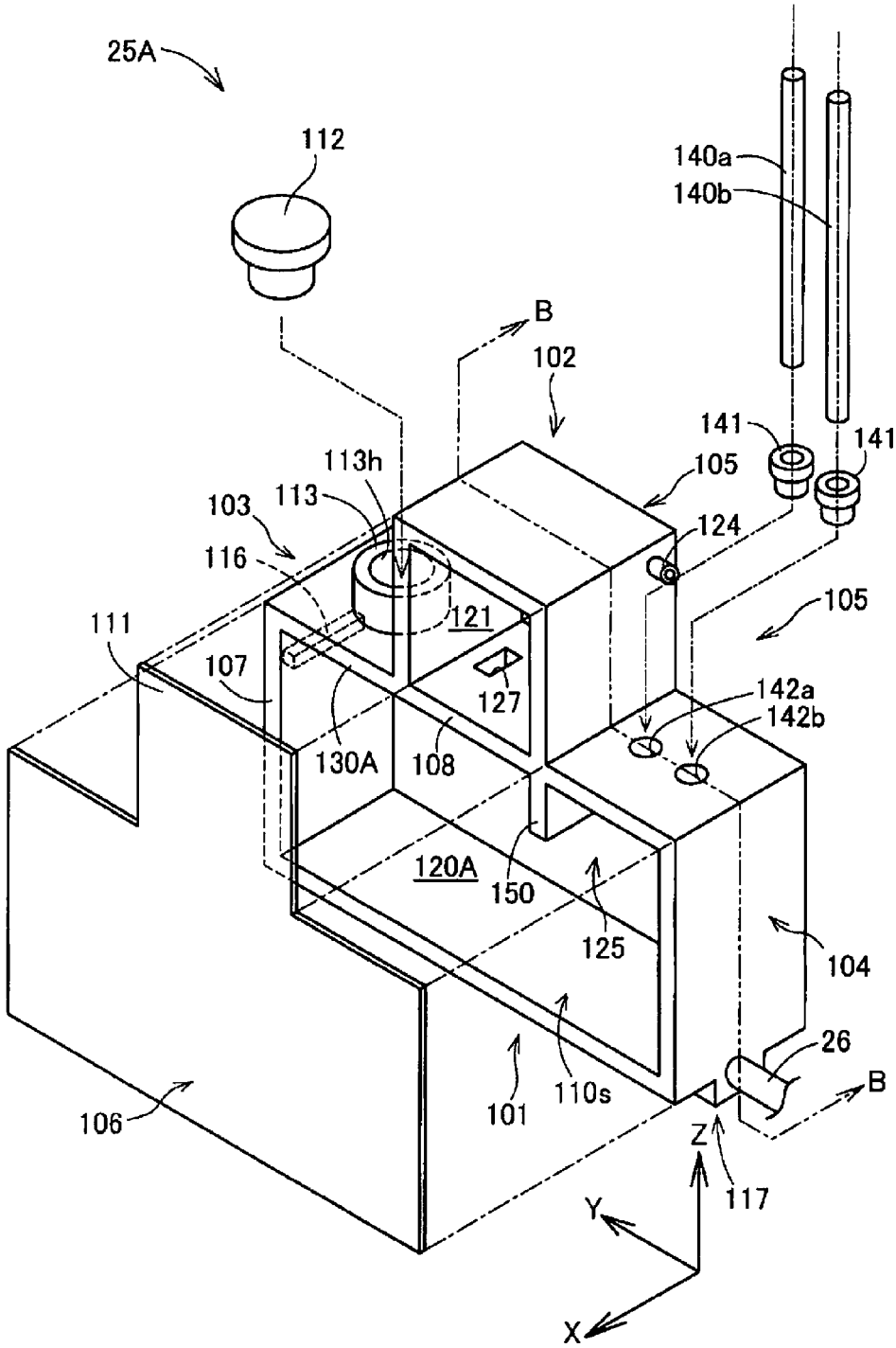
FIG. 5 is a schematic exploded perspective diagram of an ink tank of a second embodiment.
Figure 6:
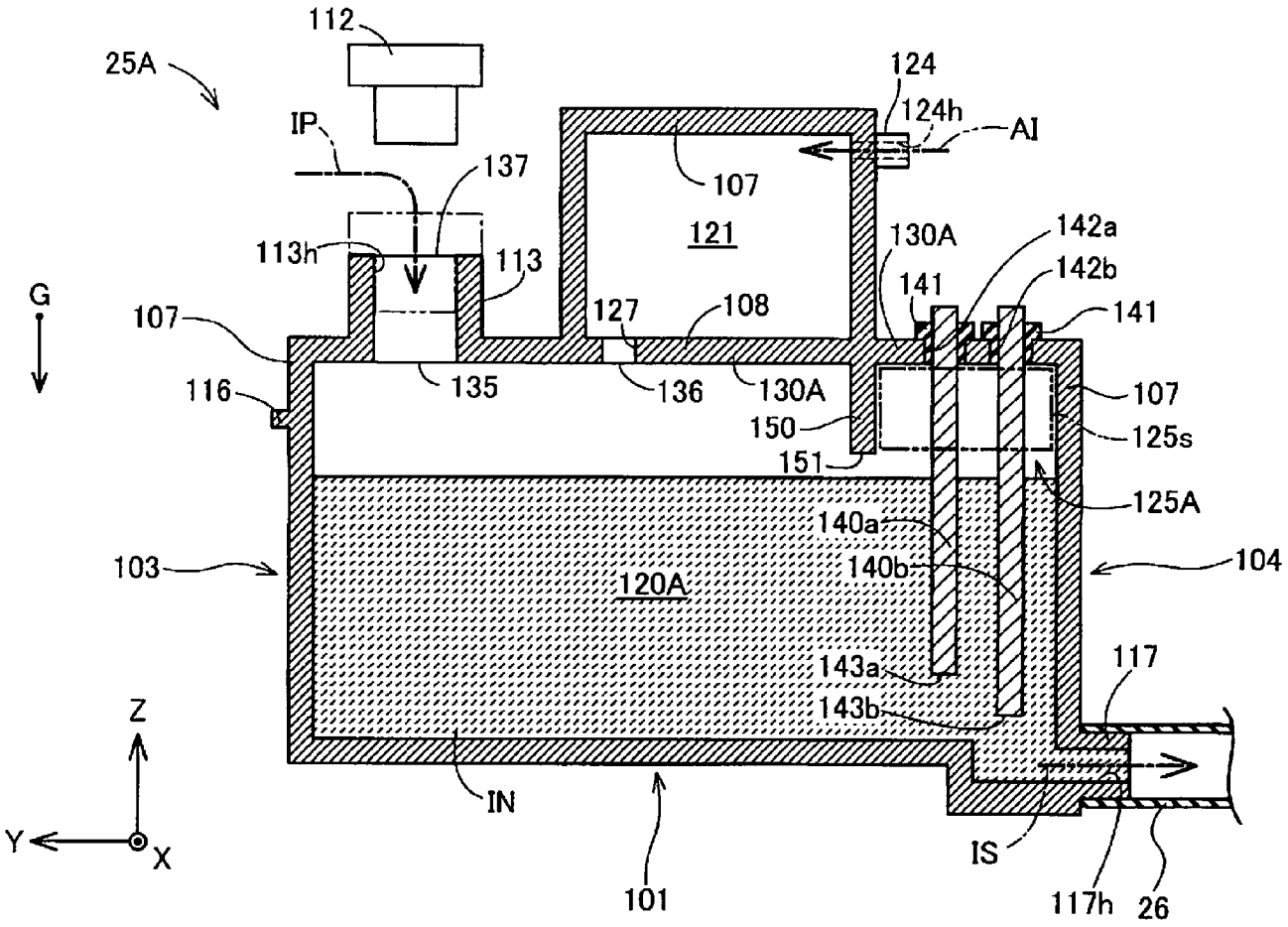
FIG. 6 is a schematic cross-sectional diagram of the ink tank of the second embodiment.
Figure 7:
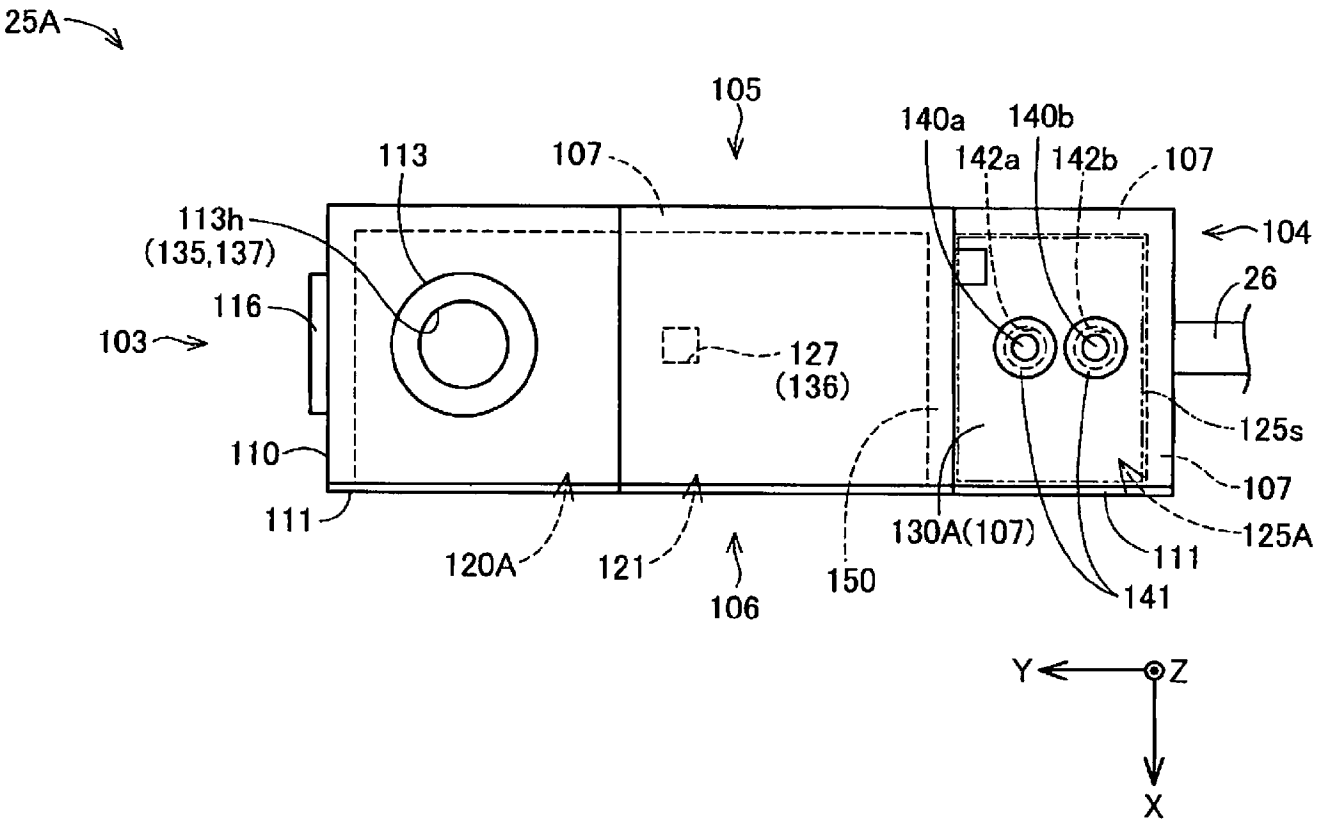
FIG. 7 is a schematic top view diagram of the ink tank of the second embodiment.

The configuration of an ink tank 25A as a second embodiment of the invention will be described with reference to FIGS. 5 to 7. FIG. 5 is a schematic exploded perspective diagram of the ink tank 25A of the second embodiment. FIG. 6 is a schematic cross-sectional diagram of the ink tank 25A of the second embodiment in a cross section taken along B-B shown in FIG. 5. FIG. 6 schematically illustrates a state in which the ink IN is stored in an ink container 120A and the cap member 112 has been removed from the ink injecting part 113. FIG. 7 is a schematic top view diagram of the ink tank 25A of the second embodiment when viewed in a direction opposite to the direction of the arrow Z. In FIG. 7, parts of the internal structure is illustrated with broken lines.

The ink tank 25A of the second embodiment has the same configuration as that of the ink tank 25 of the first embodiment except for the points described below, and is mounted to the printer 10 (FIG. 1) that has the same configuration as that described in the first embodiment. In the following description and reference drawings, the same reference signs as those used in the first embodiment are used for constituent elements that are the same as or correspond to the constituent elements described in the first embodiment.

In the ink tank 25A of the second embodiment, an upper wall part 130A of the ink container 120A horizontally extends in the front-back direction, and the internal space of the ink container 120A has a substantially rectangular parallelepiped shape (FIGS. 2 and 3). The ink container 120A is provided with a partition wall part 150. The partition wall part 150 extends downward from the upper wall part 130A at a position between the third face part 103 and the fourth face part 104. The partition wall part 150 is formed in a region on the fourth face part 104 side that is closer to the fourth face part 104 than the center of the ink container 120 in the front-back direction (FIG. 5).

A lower end 151 of the partition wall part 150 is positioned between the upper wall part 130A and the outer wall part 107 facing the upper wall part 130A in the height direction and constituting the bottom wall part of the ink container 120A. More specifically, the lower end 151 of the partition wall part 150 is formed in a region on the upper wall part 130A side that is closer to the upper wall part 130A than the center of the ink container 120 in the height direction. The end of the partition wall part 150 on the fifth face part 105 side is coupled to the outer wall part 107 that constitutes the fifth face part 105 (FIG. 7). In addition, the end face of the partition wall part 150 on the sixth face part 106 side is welded to the sheet member 111, similarly to the outer wall part 107 and the inner wall part 108.

In this manner, in the ink tank 25A in the second embodiment, an upper region in the ink container 120A is partitioned into two in the front-back direction by the partition wall part 150 (FIGS. 6 and 7). Accordingly, a recess 125A that is open downward in the gravity direction is formed in the upper region in the ink container 120A on the fourth face part 104 side. In the recess 125A, an upper end wall part blocking the upper side of the recess 125A is constituted by the upper wall part 130A that is positioned on the fourth face part 104 side relative to the partition wall part 150 (FIG. 6). In addition, the sidewall part blocking the lateral side of the recess 125A is constituted by the partition wall part 150, the outer wall part 107 facing the partition wall part 150 and constituting the second face part 102, the outer wall part 107 intersecting the partition wall part 150 and constituting the fifth face part 105, and the sheet member 111 (FIG. 7). In FIGS. 6 and 7, the region of the recess space 120*s*, which is a space in the recess 125A, is illustrated with a dashed double-dotted line. In the second embodiment, the above-described wall parts 130A, 150, 107 and 111 constituting the recess 125A correspond to a subordinate concept of the recess constitution wall part in the invention. In this manner, according to the ink tank 25A of the second embodiment, the recess 125A is simply constituted in the ink container 120A by adding the partition wall part 150.

In the ink tank 25A of the second embodiment, the through holes 142*a* and 142*b* for attaching the electrode pins 140*a* and 140*b* are provided in the upper wall part 130A constituting the upper end wall part of the recess 125A (FIG. 6). Accordingly, the electrode pins 140*a* and 140*b* extend downward from the recess 125A in the ink container 120A. In addition, in the ink tank 25A of the second embodiment, the ink injection port 135 and the atmospheric air introduction port 136 are provided in a region outside the recess 125A, that is, a region on the third face part 103 side relative to the partition wall part 150 (FIG. 7).

According to the ink tank 25A of the second embodiment, even in the case where the ink tank 25A is arranged to be inclined with respect to a horizontal plane, atmospheric air is retained in the recess 125A, and intrusion of the ink IN into the recess 125A is restrained, similarly to the ink tank 25 of the first embodiment. In addition, also when replenishing the ink IN, the liquid surface of the ink IN is restrained from reaching the inside of the recess 125A due to the atmospheric air retained in the recess 125A. Therefore, the ink IN is restrained from leaking to the outside from the through holes 142*a* and 142*b* for mounting the electrode pins 140*a* and 140*b*. Additionally, according to the ink tank 25A of the second embodiment, it is possible to exhibit the same actions and effects as those of the ink tank 25 of the first embodiment.

C. Third Embodiment

Figure 8:
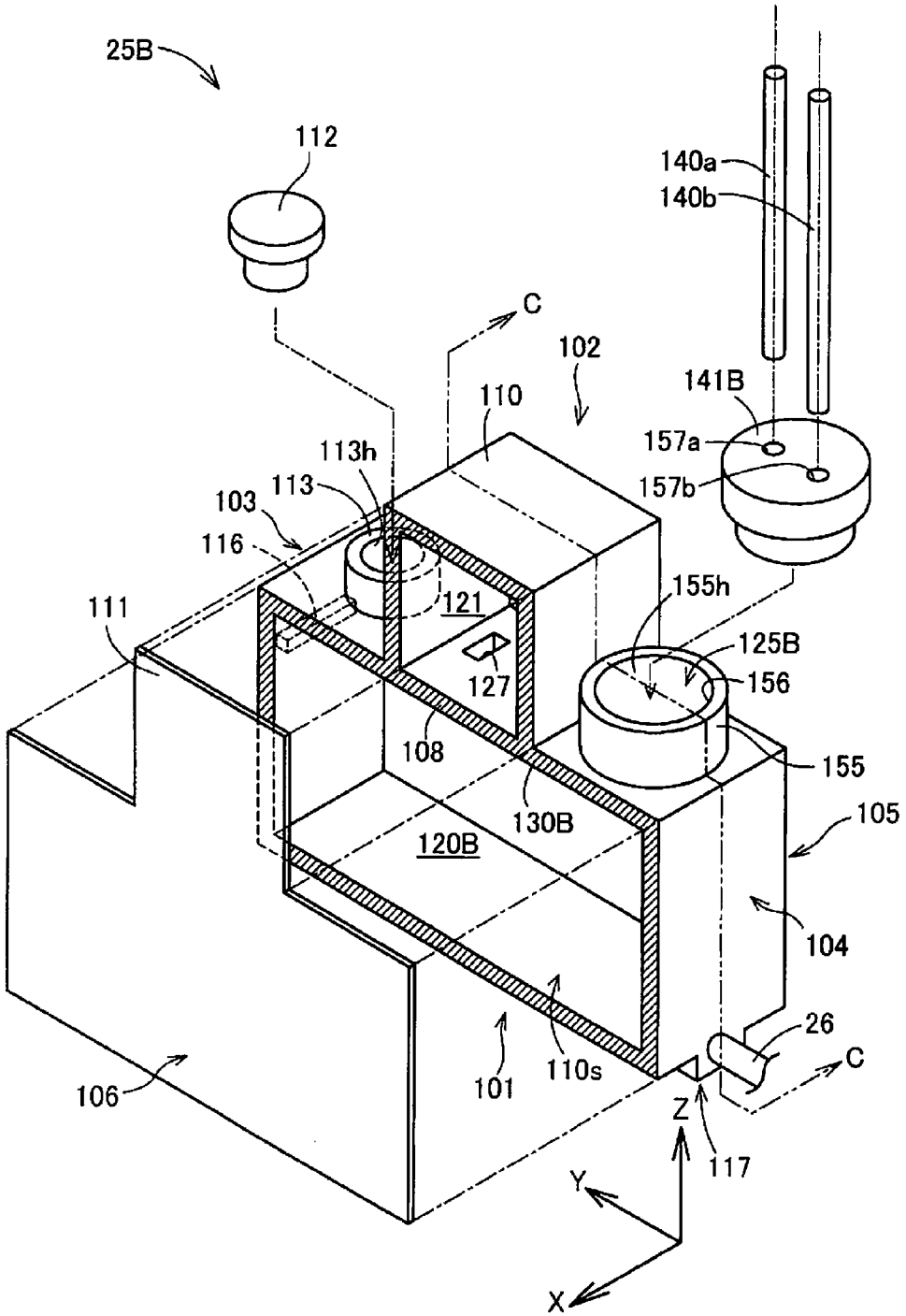
FIG. 8 is a schematic exploded perspective diagram of an ink tank of a third embodiment.
Figure 9:
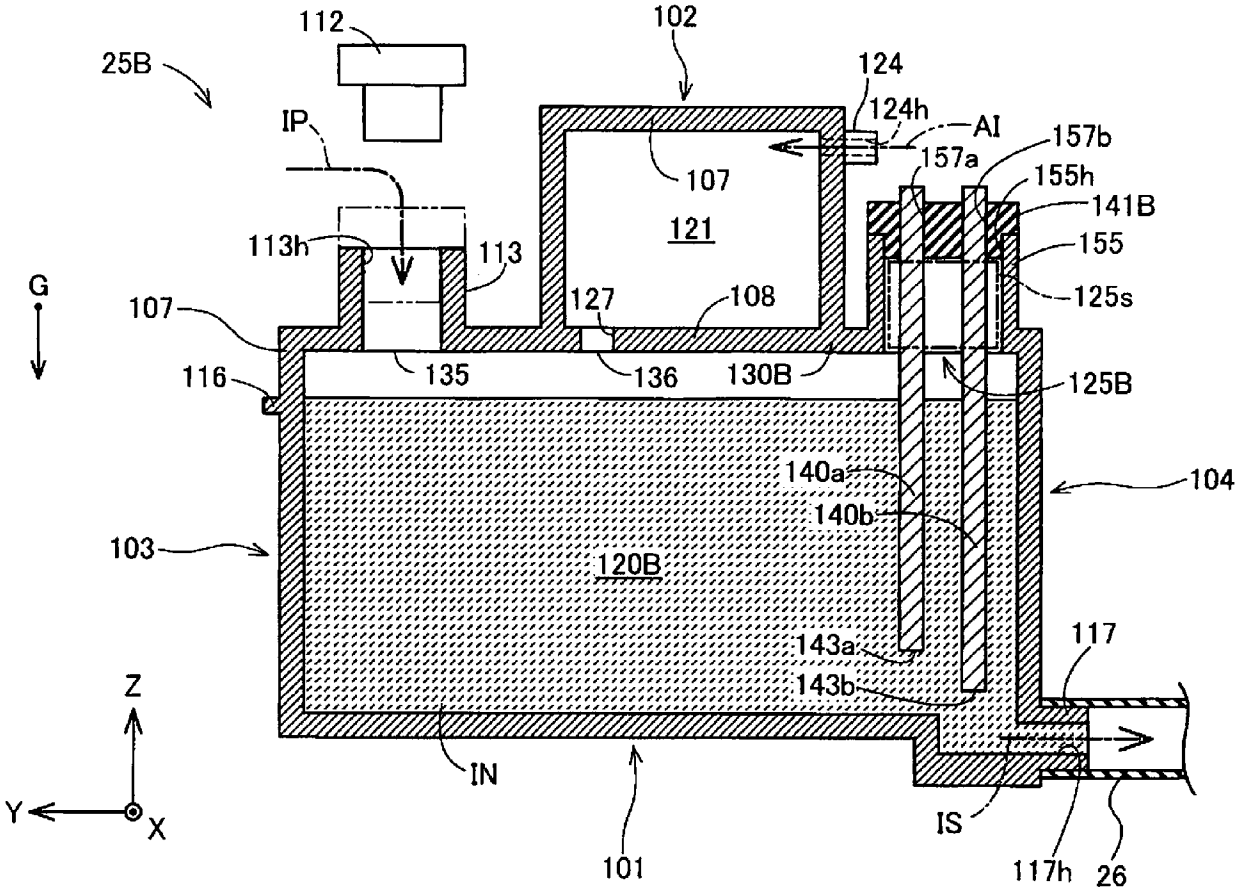
FIG. 9 is a schematic cross-sectional diagram of the ink tank of the third embodiment.
Figure 10:
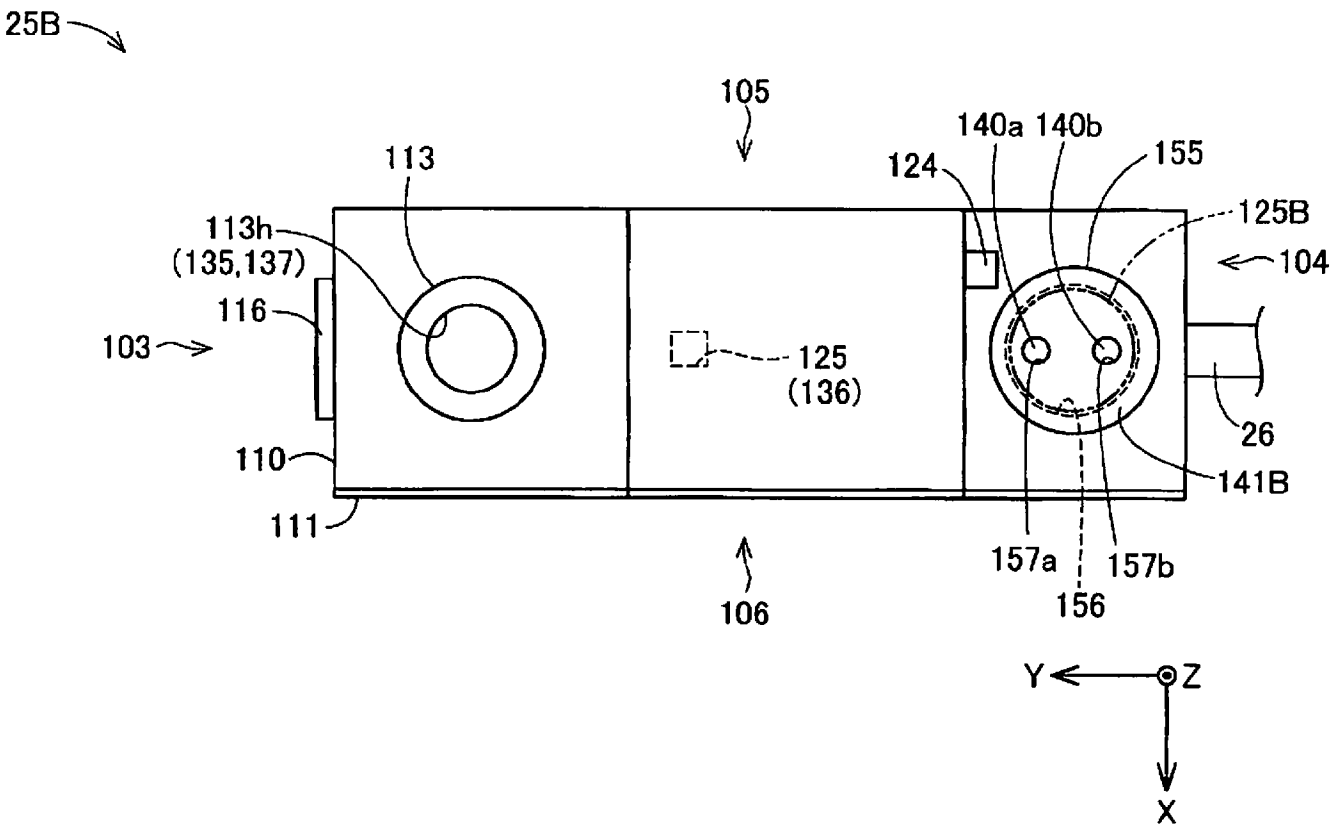
FIG. 10 is a schematic top view diagram of the ink tank of the third embodiment.

The configuration of an ink tank 25B as a third embodiment of the invention will be described with reference to FIGS. 8 to 10. FIG. 8 is a schematic exploded perspective diagram of the ink tank 25B of the third embodiment. FIG. 9 is a schematic cross-sectional diagram of the ink tank 25B of the third embodiment in a cross section taken along C-C shown in FIG. 8. FIG. 8, a state in which the ink IN is stored in an ink container 120B and the cap member 112 has been removed from the ink injecting part 113 is schematically illustrated. FIG. 9 is a schematic top view diagram of the ink tank 25B of the third embodiment when viewed in a direction opposite to the direction of the arrow Z. In FIG. 9, parts of the internal structure is illustrated with broken lines.

The ink tank 25B of the third embodiment has the same configuration as that of the ink tank 25A of the second embodiment except for the points described below, and is mounted to the printer 10 (FIG. 1) that has the same configuration as that described in the first embodiment. In the following description and reference drawings, the same reference signs as those used in the first embodiment or the second embodiment are used for constituent elements that are the same as or correspond to the constituent elements described in the first embodiment or the second embodiment.

In the ink tank 25B of the third embodiment, the partition wall part 150 is not provided in the ink container 120B. Instead, in the ink tank 25B of the third embodiment, a cylindrical wall part 155 constituted by a cylindrical wall part protruding upward is provided in an upper wall part 130B of the ink container 120B. The cylindrical wall part 155 is provided between the atmospheric air introduction part 121 and the end on the fourth face part 104 side. A through hole 155*h* in the cylindrical wall part 155 is open downward in the ink container 120B, and the internal space of the cylindrical wall part 155 constitutes a portion of the ink container 120B.

One upper end opening 156 is open at the upper end of the cylindrical wall part 155. In the ink tank 25B of the third embodiment, one substantially columnar sealing member 141B is attached to the upper end opening 156 in an airtight manner. This sealing member 141B has two through holes 157*a* and 157*b* passing through in the direction of the arrow Z. The first electrode pin 140*a* is inserted into a first through hole 157*a* in an airtight manner, and the second electrode pin 140*b* is inserted into a second through hole 157*b* in an airtight manner. The two electrode pins 140*a* and 140*b* are attached to the upper end opening 156 of the cylindrical wall part 155 in a state of having been attached to and integrated with a sealing member 141B. According to this configuration, attachment of the electrode pins 140*a* and 140*b* is facilitated.

In the ink tank 25B of the third embodiment, a recess 125B is constituted by the cylindrical wall part 155, in the upper region on the fourth face part 104 side in the ink container 120B. In the third embodiment, the upper end wall part of the recess 125B is constituted by the sealing member 141B, and the sidewall part of the recess 125B is constituted by the cylindrical wall part 155. That is, in the third embodiment, the wall parts constituted by the sealing member 141B and the cylindrical wall part 155 correspond to a subordinate concept of the recess constitution wall part in the invention. Note that similarly to the ink tank 25A of the second embodiment, a configuration may be applied, to the ink tank 25B of the third embodiment as well, in which the electrode pins 140*a* and 140*b* as well as the sealing members 141 are attached to two through holes provided at the upper end of the cylindrical wall part 155.

In the ink tank 25B of the third embodiment as well, similarly to the ink tank 25 of the first embodiment and the ink tank 25A of the second embodiment, leakage of the ink IN from the through hole 155*h* for attaching the electrode pins 140*a* and 140*b* is restrained by providing the recess 125B constituted by the cylindrical wall part 155. In particular, in the ink tank 25B of the third embodiment, a recess space 125*s* in the recess 125B is constituted as a local space protruding upward from the ink container 120B, and thus an effect of restraining intrusion of the ink IN into the recess space 125*s* is further enhanced. Additionally, according to the ink tank 25B of the third embodiment, it is possible to exhibit the same actions and effects as those of the ink tank 25 of the first embodiment and the ink tank 25A of the second embodiment.

D. Fourth Embodiment

Figure 11:
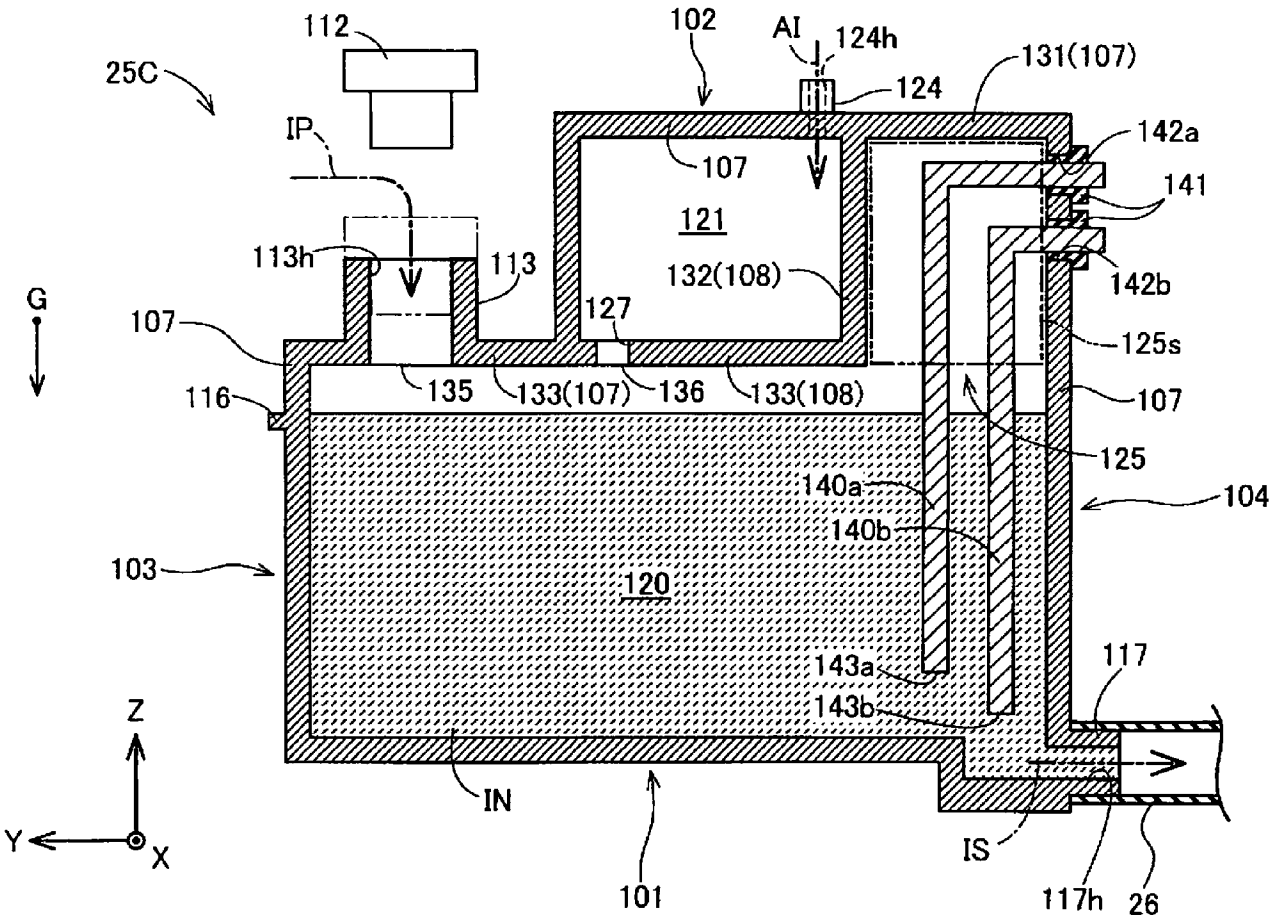
FIG. 11 is a schematic cross-sectional diagram of an ink tank of a fourth embodiment.

FIG. 11 is a schematic cross-sectional diagram showing the configuration of an ink tank 25C as a fourth embodiment of the invention. The cross-sectional position of the ink tank 25C of the fourth embodiment in FIG. 11 is a position corresponding to the cross section taken along A-A shown in FIG. 2. In FIG. 11, a state in which the ink IN is stored in the ink container 120 and the cap member 112 has been removed from the ink injecting part 113 is schematically illustrated.

The ink tank 25C of the fourth embodiment has the same configuration as that of the ink tank 25 of the first embodiment except for the points described below, and is mounted to the printer 10 (FIG. 1) that has the same configuration as that described in the first embodiment. In the following description and reference drawings, the same reference signs as those used in the first embodiment are used for constituent elements that are the same as or correspond to the constituent elements described in the first embodiment.

In the ink tank 25C of the fourth embodiment, the first upper wall part 131 constituting the upper end wall part of the recess 125 is provided at a height position that is substantially the same as that of the outer wall part 107 constituting the upper end of the atmospheric air introduction part 121. Thus, the atmospheric air intake part 124 is provided at the upper end of the atmospheric air introduction part 121 in order to avoid interference with the forming region of the recess 125.

In the ink tank 25C of the fourth embodiment, the through holes 142*a* and 142*b* into which the electrode pins 140*a* and 140*b* are to be inserted are formed in the outer wall part 107 constituting the sidewall part of the recess 125 and constituting the fourth face part 104. Thus, in the fourth embodiment, the electrode pins 140*a* and 140*b* are inserted in the direction of the arrow Y toward the ink container 120, are bent downward in the recess 125, and extend downward from the recess 125. In the ink tank 25C of the fourth embodiment, the circuit units 27 are arranged on the fourth face part 104 side.

In the ink tank 25C of the fourth embodiment as well, similarly to the ink tank 25 of the first embodiment, leakage of the ink IN from the through holes 142*a* and 142*b* is restrained by providing the recess 125. In addition, in the ink tank 25C of the fourth embodiment, the through holes 142*a* and 142*b* are provided on the fourth face part 104 side. Therefore, outside the ink tank 25C of the fourth embodiment, ink droplets that flew from the ink injecting part 113 are restrained from reaching the through holes 142*a* and 142*b*, when the ink IN is replenished from the ink injecting part 113 or the like. Additionally, with the ink tank 25C of the fourth embodiment, it is possible to exhibit the same actions and effects as those of the ink tank 25 of the first embodiment.

E. Fifth Embodiment

Figure 12:
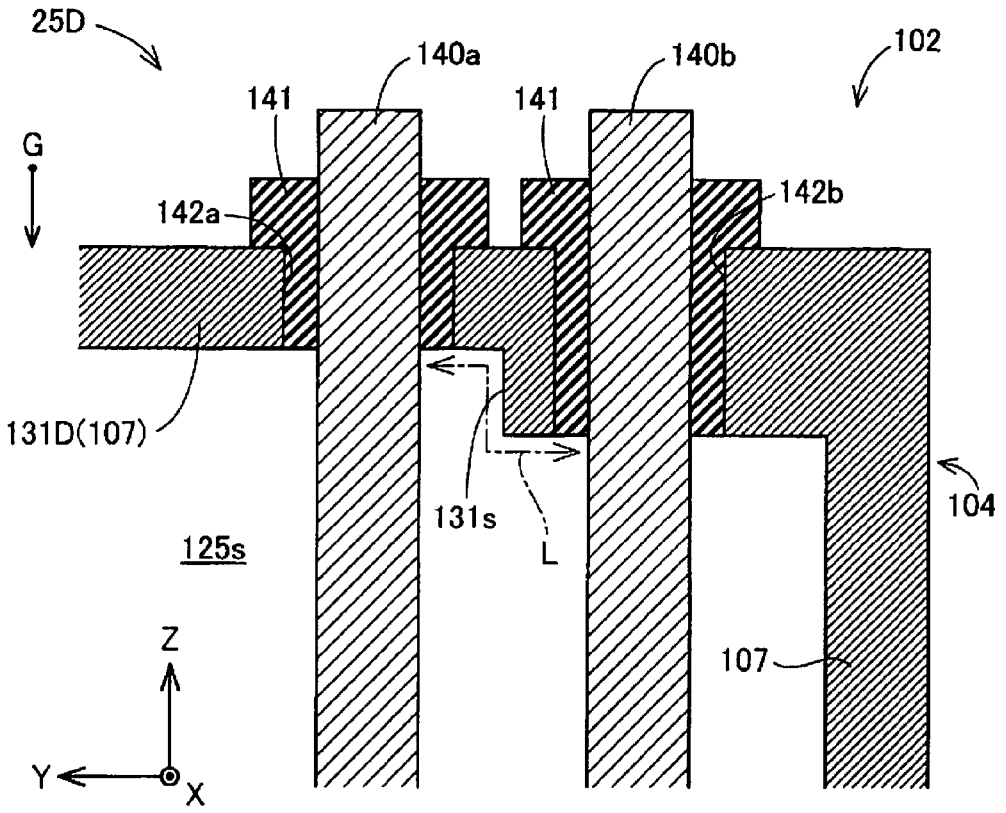
FIG. 12 is a schematic cross-sectional diagram for describing a configuration of an ink tank as a fifth embodiment.

FIG. 12 is a schematic cross-sectional diagram for describing the configuration of an ink tank 25D as a fifth embodiment of the invention. In FIG. 12, a schematic cross section of the electrode pins 140*a* and 140*b* at the mounting sections thereof in the ink tank 25D of the fifth embodiment is illustrated. The cross-sectional position in FIG. 12 is a position corresponding to the cross section taken along A-A shown in FIG. 1. The configuration of the ink tank 25D of the fifth embodiment is substantially the same as that of the ink tank 25 of the first embodiment, except that the structure of the mounting sections of the electrode pins 140*a* and 140*b* is different.

In the ink tank 25D of the fifth embodiment, a level difference part 131*s* is provided between the two through holes 142*a* and 142*b*, in a first upper wall part 131D constituting the upper end wall part of the recess 125. Accordingly, in the wall face of the first upper wall part 131D that faces downward, the height position of the wall face on the second through hole 142*b* side is lower than the height position of the wall face on the first through hole 142*a* side.

By providing such a configuration, a distance L between the first through hole 142*a* and the second through hole 142*b* along the upper wall face of the first upper wall part 131D increases by the size of the level difference part 131*s*. Therefore, even in the case where ink in the ink container 120 flies and adheres to the first upper wall part 131D, occurrence of short-circuiting between the electrode pins 140*a* and 140*b* due to the ink is restrained. Additionally, with the ink tank 25D of the fifth embodiment, it is possible to exhibit the same actions and effects as those of the ink tank 25 of the first embodiment. Note that the configuration of the level difference part 131*s* of the first upper wall part 131D of the ink tank 25D of the fifth embodiment may be applied to the ink tanks 25A to 25C of the above-described embodiments.

F. Sixth Embodiment

Figure 13:
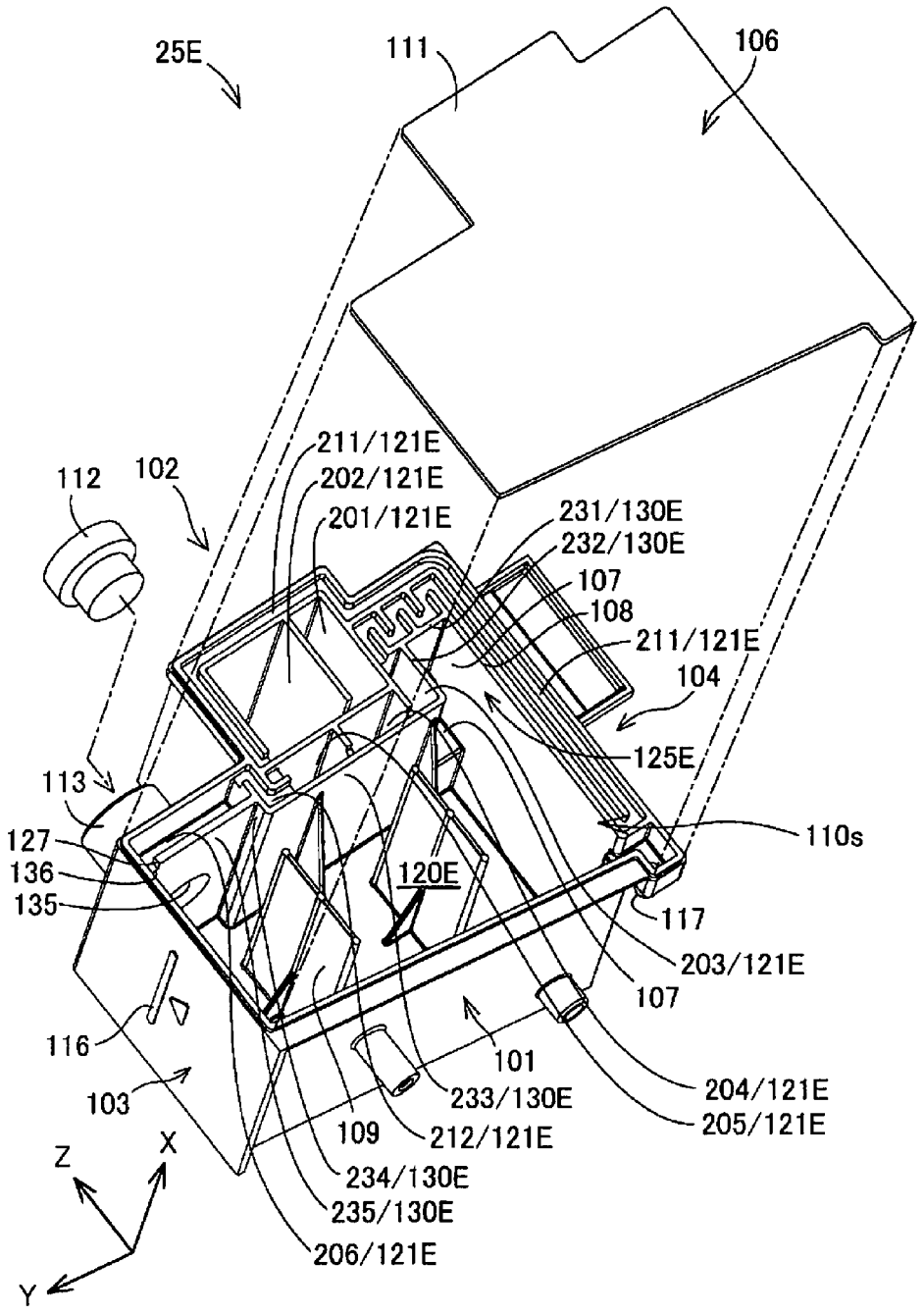
FIG. 13 is a schematic exploded perspective diagram of an ink tank of a sixth embodiment.
Figure 14:
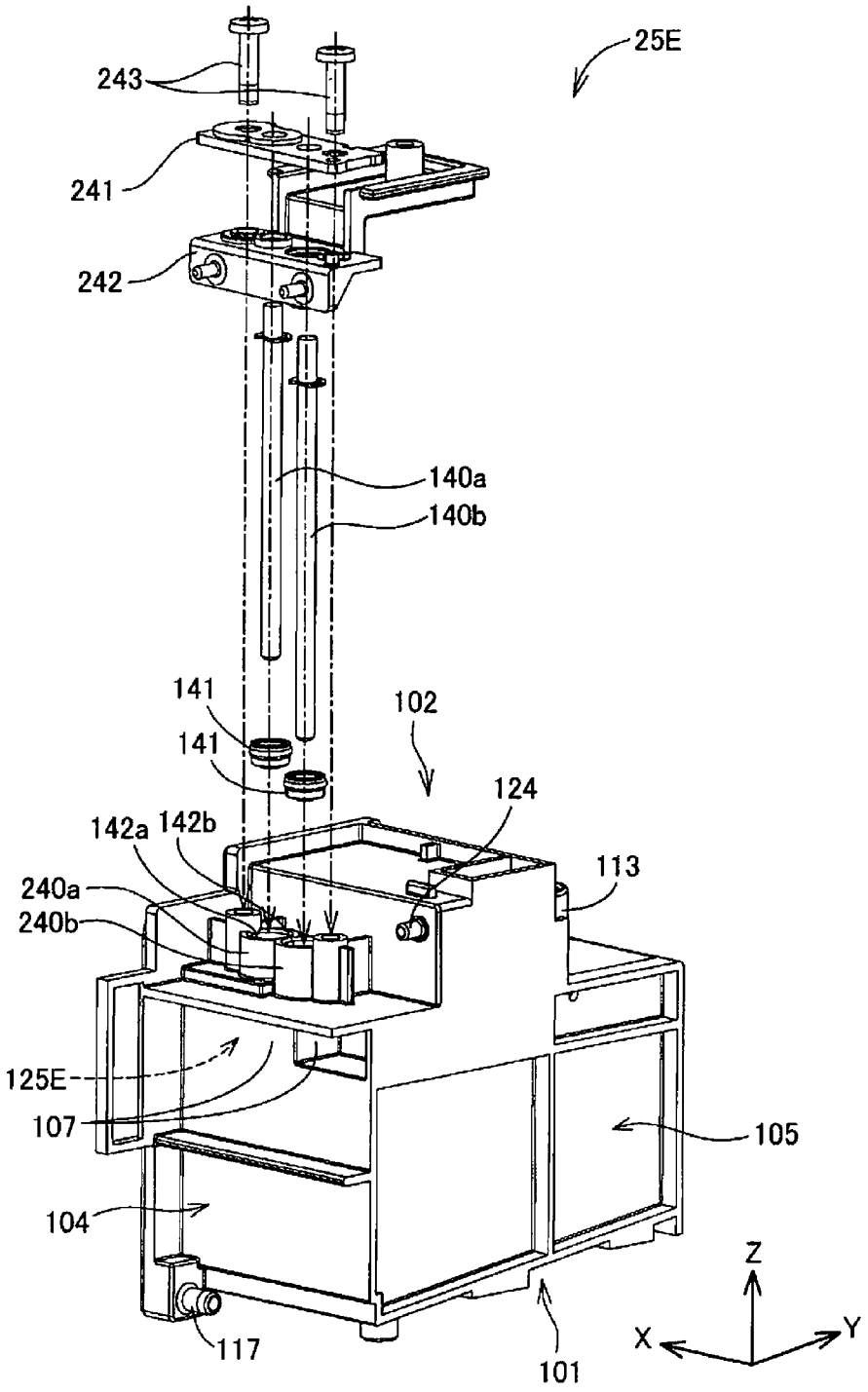
FIG. 14 is a schematic exploded perspective diagram of the ink tank of the sixth embodiment.
Figure 15:
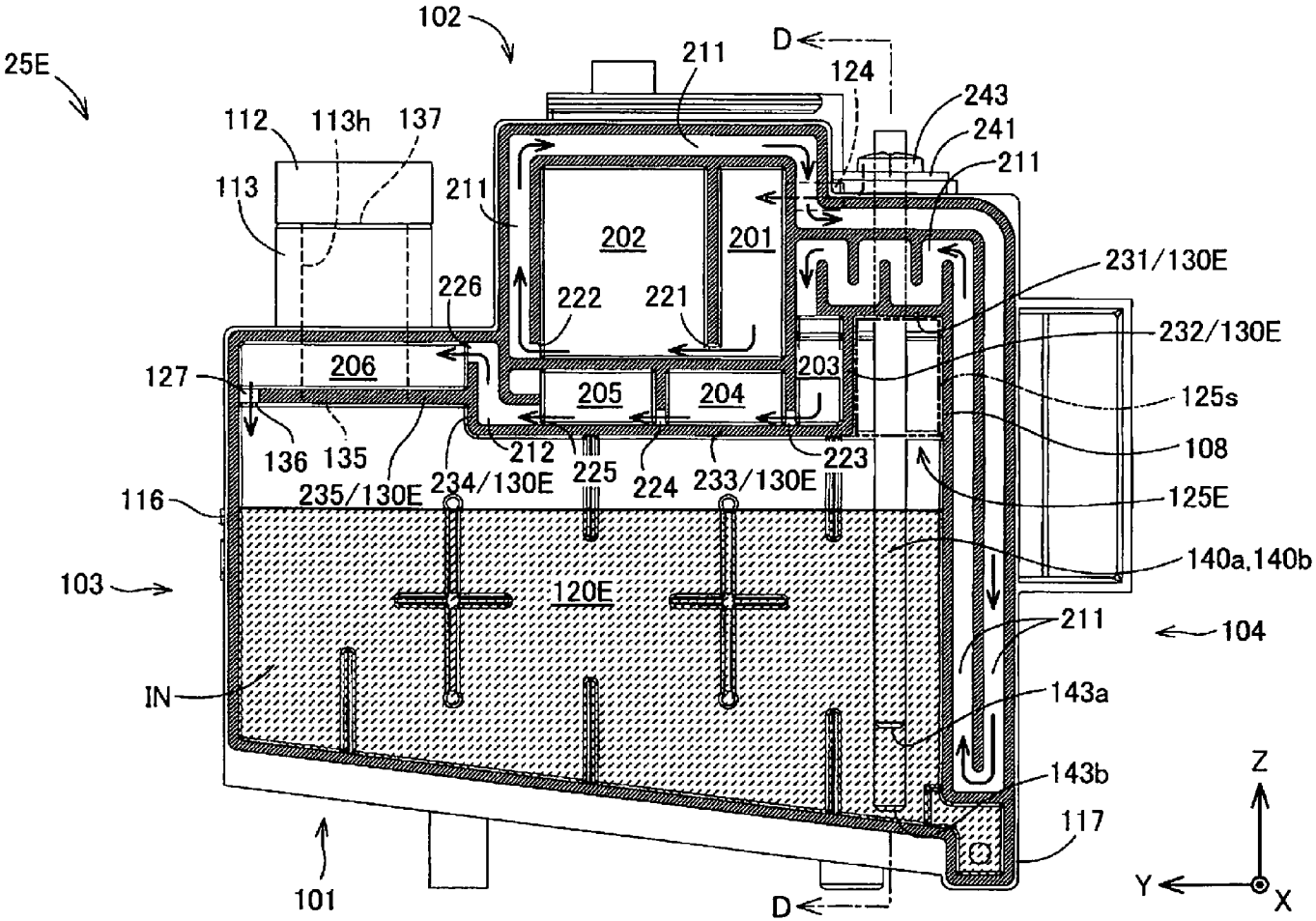
FIG. 15 is a schematic cross-sectional diagram of the ink tank of the sixth embodiment.
Figure 16:
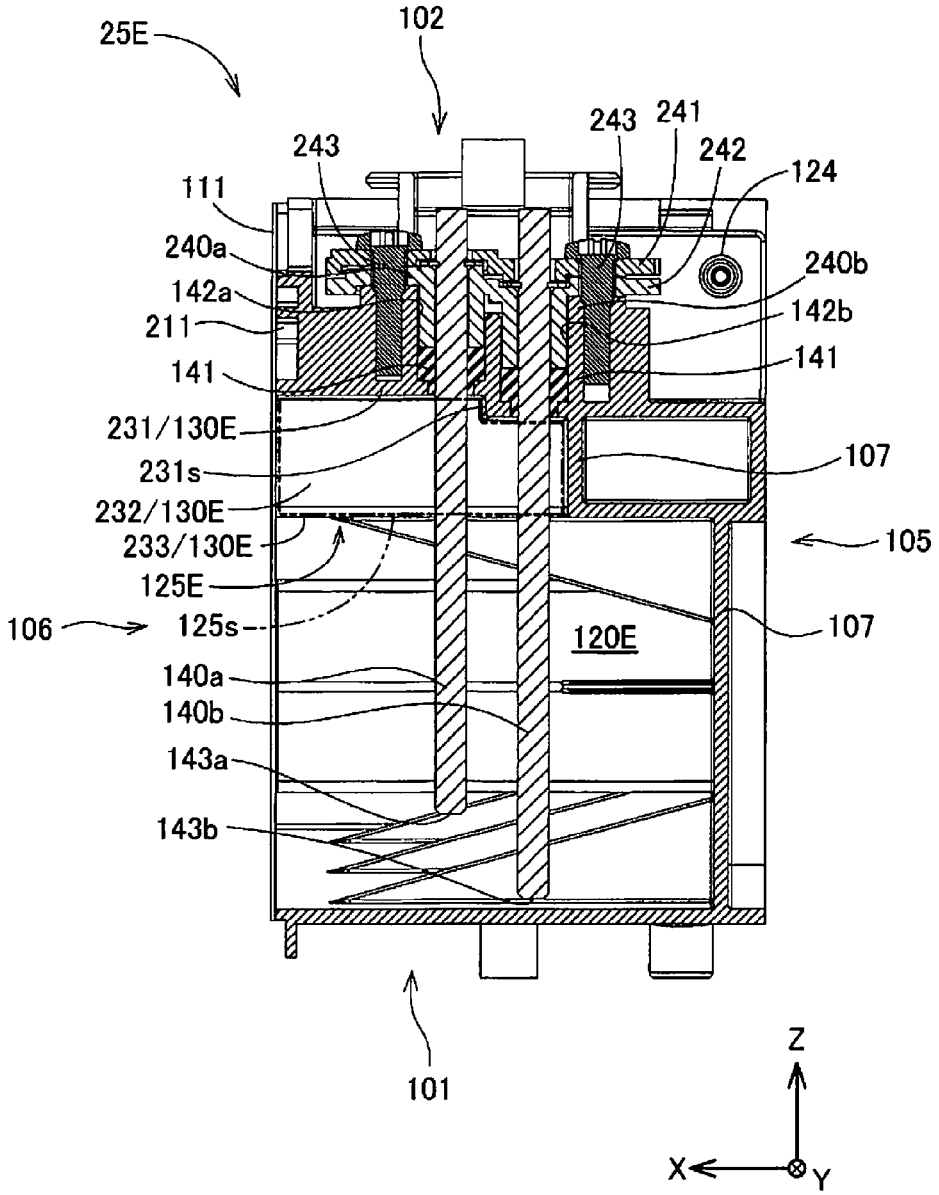
FIG. 16 is a schematic cross-sectional diagram of the ink tank of the sixth embodiment.
Figure 17:
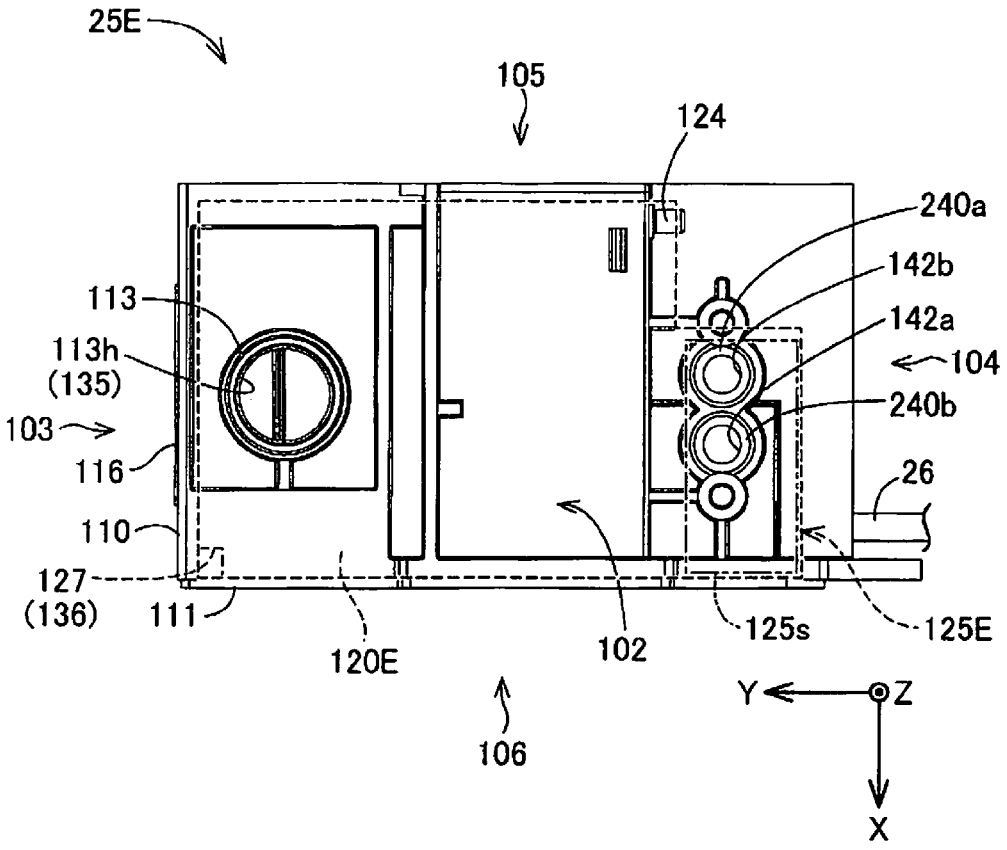
FIG. 17 is a schematic top view diagram of the ink tank of the sixth embodiment.

The configuration of an ink tank 25E as a sixth embodiment of the invention will be described with reference to FIGS. 13 to 17. FIG. 13 is a schematic exploded perspective diagram of the ink tank 25E of the sixth embodiment on the third face part 103 side when viewed obliquely from below. FIG. 14 is a schematic exploded perspective diagram of the ink tank 25E of the sixth embodiment on the fourth face part 104 side when viewed obliquely from above. FIG. 15 is a schematic cross-sectional diagram of the ink tank 25E of the sixth embodiment at a junction face between the case member 110 and the sheet member 111. In FIG. 15, a state in which the ink IN is stored in an ink container 120E is schematically illustrated. In addition, in FIG. 15, an arrow indicating a flow of atmospheric air from the atmospheric air introduction part 121 to the ink container 120 is illustrated. FIG. 16 is a schematic cross-sectional diagram of the ink tank 25E of the sixth embodiment in a cross section taken along D-D shown in FIG. 15. FIG. 17 is a schematic top diagram of the ink tank 25E of the sixth embodiment when viewed in the direction opposite to the direction of the arrow Z. In FIG. 17, a state before the cap member 112 and the electrode pins 140*a* and 140*b* are attached is illustrated. In the following description and reference drawings, the same reference signs as those used in the above-described embodiments are used for constituent elements that are the same as or correspond to the constituent elements described in the above-described embodiments.

In the ink tank 25E of the sixth embodiment, similarly to the ink tank 25 of the first embodiment, an opening part of the case member 110 on the sixth face part 106 side is sealed by the sheet member 111 that is welded thereto (FIG. 13). At a position in the second face part 102 of the case member 110 on the third face part 103 side in the front-back direction, the ink injecting part 113 having a substantially cylindrical shape is formed to protrude in the direction of the arrow Z. In the third face part 103 of the case member 110, the mark part 116 is formed. At least a part of or the entire wall part of the third face part 103 of the case member 110 is constituted so as to be transparent or translucent. The internal space 110*s* of the case member 110 is partitioned into the ink container 120E and an atmospheric air introduction part 121E by the inner wall part 108 (FIGS. 13 and 15).

The ink container 120E is formed as a recess space opening in the direction of the arrow X in the case member 110 (FIG. 13). A forming region of the ink container 120E covers substantially the entire region of the ink tank 25E of the sixth embodiment in the width direction and the front-back direction. An upper wall part 130E of the ink container 120E is constituted by the inner wall part 108 between the ink container 120E and the atmospheric air introduction part 121E. The upper wall part 130E has a plurality of wall parts 231 to 235 (to be described in details) that are different in height position, extending direction and the like. A plurality of reinforcing ribs 109 erected in parallel to the direction of the arrow X are provided in the ink container 120E. The reinforcing ribs 109 may be omitted.

Similarly to the ink container 120E, the atmospheric air introduction part 121E is formed as a recess space that is open in the direction of the arrow X in the case member 110. The atmospheric air introduction part 121E is formed along the outer periphery of the ink container 120E on the second face part 102 side and the outer periphery on the fourth face part 104 side. The atmospheric air introduction part 121E has six buffer chambers 201 to 206, a first atmospheric air passage 211, and a second atmospheric air passage 212.

The six buffer chambers 201 to 206 are formed as hollow sections having a space having a substantially rectangular parallelepiped shape. The buffer chambers 201 to 206 have a function of retaining the ink IN, such that the ink IN that intruded from the ink container 120E into the atmospheric air introduction part 121E do not leak to the outside without being interrupted. Five buffer chambers 201 to 205 out of the six buffer chambers 201 to 206 have a depth in the direction of the arrow X that is substantially the same as the depth of the ink container 120, and cover substantially the entire region in the direction of the arrow X. The sixth buffer chamber 206 is constituted to have a smaller depth in the direction of the arrow X than the other buffer chambers 201 to 205 in order to avoid interference with the ink injecting part 113.

The two atmospheric air passages 211 and 212 are formed as grooves extending parallel to the surface of the sheet member 111. Both the two atmospheric air passages 211 and 212 have a smaller depth in the direction of the arrow X than the six buffer chambers 201 to 206. In the ink tank 25E of the sixth embodiment, the buffer chambers 200 to 206 and the atmospheric air passages 211 and 212 are laid out as follows.

The first buffer chamber 201 and the second buffer chamber 202 are arranged adjacent to each other in the direction of the arrow Y, approximately at a center position of the second face part 102 in the direction of the arrow Y (FIG. 15). The first buffer chamber 201 and the second buffer chamber 202 are formed such that the positions of the top faces of those chambers are aligned in the direction of the arrow Z and the positions of bottom faces of those chambers are aligned in the direction of the arrow Z. The first buffer chamber 201 and the second buffer chamber 202 are formed at a position overlapping the ink injecting part 113 when the ink tank 25E of the sixth embodiment is viewed in the direction of the arrow Y. The top faces of the first buffer chamber 201 and the second buffer chamber 202 are at a position higher than the ink intake port 137 of the ink injecting part 113.

The atmospheric air intake part 124 is connected to the upper end of the first buffer chamber 201. The first buffer chamber 201 and the second buffer chamber 202 communicate with each other via a first communication port 221 formed at the lower end thereof. The second buffer chamber 202 is connected to the first atmospheric air passage 211 via a second communication port 222 formed at the lower end of the sidewall face on the side in the direction of the arrow Y.

The first atmospheric air passage 211 extends from the second communication port 222 over the first buffer chamber 201 and the second buffer chamber 202 along the outer peripheries of the second buffer chamber 202 and the first buffer chamber 201 to the end of the ink tank 25E on the fourth face part 104 side. At the end on the fourth face part 104 side, the first atmospheric air passage 211 then makes approximately one reciprocal movement between the second face part 102 and the first face part 101 in the direction of the arrow Z. Furthermore, the first atmospheric air passage 211 extends in the direction of the arrow Y while being bent a plurality of times like bellows in the direction of the arrow Z, and is connected to the top face of the third buffer chamber 203.

The third buffer chamber 203 is formed at a position at which the upper end thereof is adjacent to the lower end of the first buffer chamber 201 on the side in the direction opposite to the direction of the arrow Y. The fourth buffer chamber 204 is formed at a position adjacent to the lower end of the third buffer chamber 203 on the side in the direction of the arrow Y. The third buffer chamber 203 and the fourth buffer chamber 204 communicate with each other via a third communication port 223. The height positions of the bottom faces of the third buffer chamber 203 and the fourth buffer chamber 204 are aligned.

The fourth buffer chamber 204 as well as the fifth buffer chamber 205 are formed at a stage below the first buffer chamber 201 and the second buffer chamber 202. The fourth buffer chamber 204 and the fifth buffer chamber 205 are adjacent in the direction of the arrow Y in this order, and the positions of top faces of those chambers are aligned and the height positions of the bottom faces of those chambers are aligned. The fourth buffer chamber 204 and the fifth buffer chamber 205 communicate with each other via a fourth communication port 224 formed on the lower end. The positions of the ends of the fourth buffer chamber 204 and the first buffer chamber 201 on the fourth face part 104 side are aligned in the direction of the arrow Y. The positions of the ends of the fifth buffer chamber 205 and the second buffer chamber 202 on the third face part 103 side are aligned in the direction of the arrow Y.

The fifth buffer chamber 205 is connected to the second atmospheric air passage 212 via a fifth communication port 225 provided at the lower end of the sidewall face on the third face part 103 side. In the second atmospheric air passage 212, the height position of a face at the lowest position and the height position of the bottom face of the fifth buffer chamber 205 are aligned. The second atmospheric air passage 212 extends in the direction of the arrow Y, and is connected to the sixth buffer chamber 206 via a sixth communication port 226.

The sixth buffer chamber 206 is positioned at the end of the ink tank 25E of the sixth embodiment on the third face part 103 side, and is formed at a position overlapping the lower end of the ink injecting part 113 when the ink tank 25E of the sixth embodiment is viewed in the direction of the arrow X.

The communication path 127 communicating with the ink container 120E is formed at the end of the bottom face of the sixth buffer chamber 206 on the third face part 103 side. The communication path 127 is formed as a recess of the inner wall part 108 provided between the inner wall part 108 and the sheet member 111. Atmospheric air taken into the first buffer chamber 201 via the atmospheric air intake part 124 reaches the sixth buffer chamber 206 via a route in the atmospheric air introduction part 121E indicated by an arrow, and is introduced into the ink container 120E via the communication path 127.

The upper wall part 130E of the ink container 120E has a first upper wall part 231, a first sidewall part 232, a second upper wall part 233, a second sidewall part 234, and the third upper wall part 235 (FIG. 15). The first upper wall part 231 is positioned at the end of the ink container 120E on the side in the direction opposite to the direction of the arrow Y, and extends in the direction of the arrow Y on the lower side of a section of the first atmospheric air passage 211 that is bent like bellows. The first upper wall part 231 is positioned at the highest position in the upper wall part 130E.

The first sidewall part 232 extends downward from the end of the first upper wall part 231 on the side in the direction of the arrow Y. The first sidewall part 232 constitutes a sidewall part of the third buffer chamber 203 on the side in the direction opposite to the direction of the arrow Y. The first sidewall part 232 also constitutes a level difference part between the first upper wall part 231 and the second upper wall part 233.

The second upper wall part 233 extends from the lower end of the first sidewall part 232 in the direction of the arrow Y, and constitutes the bottom wall part of the fourth buffer chamber 204 and the fifth buffer chamber 205. The second sidewall part 234 extends upward from the end of the second upper wall part 233 on the side in the direction of the arrow Y. The second sidewall part 234 constitutes a level difference part between the second upper wall part 233 and the third upper wall part 235.

The third upper wall part 235 extends from the upper end of the second sidewall part 234 in the direction of the arrow Y, and constitutes the bottom wall part of the sixth buffer chamber 206. The third upper wall part 235 is positioned at a height position that is higher than the second upper wall part 233 and lower than the first upper wall part 231.

The third upper wall part 235 intersects the ink injecting part 113, and the ink injection port 135 is open in the wall face of the third upper wall part 235 on the ink container 120E side. The communication path 127 for communicating between the ink container 120E and the atmospheric air introduction part 121E is formed in the third upper wall part 235. The atmospheric air introduction port 136 is open in the wall face of the third upper wall part 235 on the ink container 120E side.

In the ink tank 25E of the sixth embodiment, a recess 125E is constituted by the first upper wall part 231 and the first sidewall part 232 as a part of the recess constitution wall part as follows. In FIGS. 15 to 17, the region of the recess space 125*s*, which is a space in the recess 125E, is illustrated with a dashed double-dotted line. The recess 125E of the sixth embodiment is constituted by the first upper wall part 231 as the upper end wall part. In addition, the recess 125E is constituted by the first sidewall part 232, the outer wall part 107 that is on the fourth face part 104 side, the inner wall part 108 that partitions the ink container 120E and the first atmospheric air passage 211, the outer wall part 107 that is on the fifth face part 105 side, and the sheet member 111, as sidewall parts. In the ink tank 25E of the sixth embodiment, the pair of the electrodes 140*a* and 140*b* extend into the ink container 120E via the recess 125E as described below.

In the ink tank 25E of the sixth embodiment, the pair of the electrode pins 140*a* and 140*b* are respectively inserted into the ink container 120E via the through holes 142*a* and 142*b* of two cylindrical parts 240*a* and 240*b* that are provided so as to protrude upward in the second face part 102 (FIG. 14). The two cylindrical parts 240*a* and 240*b* are arranged in the region above the second face part 102 on the fourth face part 104 side in the direction of the arrow X. A first cylindrical part 240*a* is positioned on the sixth face part 106 side, and a second cylindrical part 240*b* is positioned on the fifth face part 105 side.

In the ink tank 25E of the sixth embodiment, the outer wall part 107 positioned above the first buffer chamber 201 and the second buffer chamber 202 protrudes upward between the ink injecting part 113 and the two cylindrical parts 240*a* and 240*b* (FIG. 15). In addition, the height position of the upper end faces of the cylindrical parts 240*a* and 240*b* is higher than that of the ink intake port 137 in the ink injecting part 113. Due to this configuration, in the ink tank 25E of the sixth embodiment, ink droplets are restrained from flying from the ink injecting part 113 to the through holes 142*a* and 142*b* in the case where the ink IN is replenished or the like, similarly to the ink tank 25 of the first embodiment.

The two cylindrical parts 240*a* and 240*b* are provided above the first upper wall part 231 of the ink container 120E (FIG. 17). The through holes 142*a* and 142*b* of the two cylindrical parts 240*a* and 240*b* pass through the first upper wall part 231, and reach the ink container 120E (FIG. 16). The first electrode pin 140*a* is inserted into the ink container 120 via the first through hole 142*a* of the first cylindrical part 240*a*. The second electrode pin 140*b* is inserted into the ink container 120 via the second through hole 142*b* of the second cylindrical part 240*b*.

The cylindrical sealing member 141 is arranged between the inner peripheral surface of the first through hole 142*a* and the first electrode pin 140*a*. The cylindrical sealing member 141 is also arranged between the inner peripheral surface of the second through hole 142*b* and the second electrode pin 140*b*. The sealing members 141 are exposed to the ink container 120E at the first upper wall part 231.

The ink tank 25E of the sixth embodiment is provided with a first fixing member 240, a second fixing member 242 and two screws 243 for fixing the pair of the electrode pins 140*a* and 140*b* (FIG. 14). The first fixing member 240 and the second fixing member 242 each have two through holes, and are used for coupling the electrode pins 140*a* and 140*b* to each other by inserting the electrode pins 140*a* and 140*b* into the through holes.

The first fixing member 240 and the second fixing member 242 are arranged in a stacked state on the two cylindrical parts 240*a* and 240*b*, in the state where the electrode pins 140*a* and 140*b* are coupled to each other, the first fixing member 240 being on the upper side and the second fixing member 242 being on the lower side (FIGS. 14 and 16). The first fixing member 240 and the second fixing member 242 are fixed, at the two ends thereof in the direction of the arrow X, to the case member 110 by the two screws 243.

In this manner, in the ink tank 25E of the sixth embodiment, the pair of the electrode pins 140*a* and 140*b* are inserted into the ink container 120E via the through holes

142*a* and 142*b* provided in the first upper wall part 231 constituting the upper end wall part of the recess 125E. Because atmospheric air is retained in the recess 125E, intrusion of the ink IN is restrained, similar to the recess 125 described in the first embodiment. Therefore, in the ink tank 25E of the sixth embodiment as well, leakage of the ink IN from the through holes 142*a* and 142*b*, deterioration of the sealing members 141 and the like are restrained, similarly to the ink tank 25 of the first embodiment.

In the ink tank 25E of the sixth embodiment, the through holes 142*a* and 142*b*, the ink injection port 135 and the atmospheric air introduction port 136 are formed to be spaced apart in the direction of the arrow Y and sandwich the second upper wall part 233 protruding downward. The ink IN being replenished via the ink injection port 135, the ink IN intruding into the atmospheric air introduction part 121E and returning to the ink container 120E from the atmospheric air introduction port 136 or the like is restrained from reaching the through holes 142*a* and 142*b*. Note that in the ink tank 25E of the sixth embodiment, five buffer chambers 201 to 205 in the atmospheric air introduction part 121E are provided above the second upper wall part 233. In this manner, a region caused to protrude downward in order to form the recess 125E is effectively used as an arranging region for the atmospheric air introduction part 121E.

In the ink tank 25E of the sixth embodiment, furthermore, a level difference part 231*s* is formed between the first through hole 142*a* and the second through hole 142*b*, in the first upper wall part 231 (FIG. 16). Accordingly, in the first upper wall part 231, the height position of the wall face on the first through hole 142*a* side is higher than the wall face on the second through hole 142*b* side. In the ink tank 25E of the sixth embodiment, occurrence of short-circuiting between the electrode pins 140*a* and 140*b* due to adhesion of the ink IN to the first upper wall part 231 is restrained by the above-described level difference part 231*s*, similarly to the ink tank 25D of the fifth embodiment (FIG. 12).

As described above, with the ink tank 25E of the sixth embodiment, leakage of the ink IN from the through holes 142*a* and 142*b*, deterioration of the sealing members 141 and the like are restrained by providing the recess 125E. Additionally, with the ink tank 25E of the sixth embodiment, it is possible to exhibit the same actions and effects as those of the ink tanks described in the above-described embodiments.

G. Modified Examples

G1. Modified Example 1

In the ink tanks 25 and 25A to 25E of the above embodiments, the recesses 125, 125A, 125B, and 125E are formed in an upper region facing the upper wall parts 130, 130A, 130B, and 130E of the ink containers 120, 120A, 120B, and 120E. However, the recesses 125, 125A, 125B and 125E do not need to be formed in the region above the ink containers 120, 120A, 120B, and 120E, and may be formed at a center position in the height direction, for example. In this case, the electrode pins 140*a* and 140*b* may be inserted from the outer wall part 107 constituting the fifth face part 105, and bend and extend downward in the recess, in the same manner as the fifth embodiment, for example.

G2. Modified Example 2

In the ink tanks 25 and 25A to 25E of the above embodiments, the recesses 125, 125A, 125B and 125E are open in a direction parallel to the gravity direction. However, the recesses 125, 125A, 125B and 125E do not need to be open in a direction parallel to the gravity direction. It is sufficient that the recesses 125, 125A, 125B and 125E are open downward, and those recesses may be open obliquely downward, for example. In addition, the recesses 125, 125A, 125B and 125E do not need to be constituted such that the cross-sectional areas of those recesses are constant in the direction of the openings thereof, and for example, a configuration may be adopted in which the cross-sectional area decreases toward the opening.

G3. Modified Example 3

The ink tanks 25 and 25A to 25E of the above embodiments are provided with the two electrode pins 140*a* and 140*b* as the electrodes used for detection of ink. However, the electrodes used for detection of ink may have a shape different from that of the two electrode pins 140*a* and 140*b*. The electrodes used for detection of ink may have a plate-like or thin film-like shape, a band-like shape, a shape obtained by one of those shapes being complicatedly curved, or the like.

G4. Modified Example4

In the ink tanks 25 and 25A to 25E of the above embodiments, the two electrode pins 140*a* and 140*b* are partially inserted into the through holes 142*a* and 142*b*. However, the entirety of the two electrode pins 140*a* and 140*b* may be arranged in the ink container. In this case, conductive wires connected to the electrode pins 140*a* and 140*b* may be inserted in the through holes 142*a* and 142*b*. In this configuration, the conductive wires that are electrically conductive to the electrode pins 140*a* and 140*b* can be interpreted as a portion of the electrode part in the invention. In addition, the openings of the through holes 142*a* and 142*b* into which the conductive wires extend in the ink container 120 can be interpreted as a section in which the electrode part in the invention is provided.

G5. Modified Example 5

The ink tanks 25 and 25A to 25E of the above embodiments are provided with the two electrode pins 140*a* and 140*b* as a pair of electrodes. However, the ink tanks 25 and 25A to 25E of the embodiments do not need to be provided with the pair of electrodes, and may be provided with one electrode only, for example. In this case, only one electrode may be arranged in the ink container, and the other electrode may be arranged outside the ink tank in a state in which electrical continuity is secured using ink flowing into the tube 26 as a conductive path. In addition, the ink tanks 25 and 25A to 25E of the embodiments may be provided with two or more electrodes.

G6. Modified Example 6

In the ink tanks 25 and 25A to 25E of the above embodiments, the sealing members 141 are arranged between the electrode pin 140*a* and the through hole 142*a*, and between the electrode pin 140*b* and the through hole 142*b*. However, the sealing members 141 may be omitted. For example, the electrode pins 140*a* and 140*b* may be held in the through holes 142*a* and 142*b* in an airtight manner, by engaging projections provided on outer peripheries of the electrode pins 140*a* and 140*b* with projections or recesses provided on the inner wall surfaces of the through holes 142*a* and 142*b*.

G7. Modified Example 7

In the above embodiments, the reference posture, which is the posture when the ink tanks 25 and 25A to 25E are mounted to the printer 10, the posture when ink is supplied to the printing head part 32, and the posture when ink is replenished by a user are the same. However, the posture when ink is replenished to the printing head part 32 and the posture when ink is replenished by a user do not need to be the same as the reference posture. In this case, it is sufficient that the recesses 125, 125A, 125B and 125E are open downward at least when the ink tanks 25 and 25A to 25E are in the posture when ink is supplied to the printing head part 32.

G8. Modified Example 8

In the ink tanks 25, 25A, 25B and 25D of the above embodiments, both the ink injection port 135 and the atmospheric air introduction port 136 are formed as openings that are open in the upper wall face of the ink container 120. However, the ink injection port 135 and the atmospheric air introduction port 136 do not need to be open in the upper wall face of the ink container 120, and may be constituted as an opening of a pipe protruding from a wall face of the ink container 120, for example. In addition, the ink injection port 135 and the atmospheric air introduction port 136 do not need to be open downward, and may be open in the horizontal direction, for example. It is sufficient that the ink injection port 135 and the atmospheric air introduction port 136 are open in a section excluding the recesses 125, 125A, 125B and 125E in the ink containers 120, 120A, 120B, and 120E.

G9. Modified Example 9

In the above embodiments, the ink tanks 25 and 25A to 25E are constituted by welding the sheet member 111 to the case member 110. However, the ink tanks 25 and 25A to 25E do not need to be constituted by welding the sheet member 111 to the case member 110. For example, the ink tanks 25 and 25A to 25E may be entirely constituted by a resin member made of a plastic or the like. Alternatively, the ink tanks 25 and 25A to 25E may be constituted by combining a container that constitutes the ink container 120 and a container that constitutes the atmospheric air introduction part 121.

G10. Modified Example 10

The ink tanks 25 and 25A to 25E of the above embodiments have, in the third face part 103, the mark part 116 indicating the position of the liquid surface of ink of a reference amount. However, the ink tanks 25 and 25A to 25E of the above embodiments do not need to have the mark part 116. In addition, in the ink tanks 25 and 25A to 25E of the above embodiments, a portion of or the entire wall part constituting the third face part 103 is constituted so as to be transparent or translucent such that a user can visually recognize the liquid surface of the ink from outside. However, in the ink tanks 25 and 25A to 25E of the above embodiments, a part of or the entire wall part other than the wall part constituting the third face part 103 may be constituted so as to be transparent or translucent, or all the wall parts may be constituted so as to be opaque.

G11. Modified Example 11

In the ink tanks 25 and 25A to 25E of the above embodiments, the ink injecting part 113 and the through holes 142*a* and 142*b* are arranged in the front-back direction. However, the ink injecting part 113 and the through holes 142*a* and 142*b* may be arranged in the width direction, or may be arranged at positions diagonally sandwiching a center position of the ink containers 120, 120A, 120B, and 120E, when viewed in the direction opposite to the direction of the arrow Z.

G12. Modified Example 12

In the ink tanks 25 and 25A to 25E of the above embodiments, between the ink injecting part 113 and the electrode pins 140*a* and 140*b*, portions of the atmospheric air introduction parts 121 and 121E protrude above the ink injecting part 113 and the electrode pins 140*a* and 140*b*. However, the atmospheric air introduction part do not need to protrude above the ink injecting part 113 and the electrode pins 140*a* and 140*b*. The atmospheric air introduction part may be formed below the ink injecting part 113 and the electrode pins 140*a* and 140*b*.

G13. Modified Example 13

The ink tanks 25 and 25A to 25E of the above embodiments are stored in the casing part 21 of the tank unit 20. However, the ink tanks 25 to 25E of the above embodiments may be stored in the casing part 31 of the printing part 30. In addition, the ink tanks 25 to 25E of the above embodiments may be connected to the printing part 30 in the state of being entirely exposed to the outside without being stored in those casing parts 21 and 31, or in the state of being held by a basket-like holding member or the like.

G14. Modified Example 14

In the above embodiments, the ink tanks 25 and 25A to 25E store ink to be supplied to the printing head part 32 of the printer 10. However, the configuration of the ink tanks 25 and 25A to 25E in the above embodiments may be applied to a tank that stores a liquid to be supplied to a liquid jetting system other than a printer. For example, the above configuration may be applied to a detergent tank for supplying detergent to a detergent jetting apparatus for jetting a liquid detergent.

The invention is not limited to the above embodiments, examples, and modifications, and can be achieved in various configurations without departing from the gist of the invention. For example, the technical features in the embodiments, examples, and modifications corresponding to the technical features in the modes can be replaced or combined as appropriate in order to solve a part of or the entire problem described above, or in order to achieve some or all of the aforementioned effects. A technical feature that is not described as essential in the specification can be deleted as appropriate.

The entire disclosure of Japanese Patent Application No. 2015-049479, filed on Mar. 12, 2015 is expressly incorporated herein by reference.

What is claimed is:

1. A tank configured to supply a liquid to a liquid jetting head that is configured to jet the liquid, the tank comprising:

a liquid container configured to store the liquid;

a liquid supply part configured to supply the liquid from the liquid container to the liquid jetting head;

a liquid injection part configured to inject the liquid into the liquid container via a liquid injection port that is open in the liquid container;

an atmospheric air introduction port;

an atmospheric air introduction part configured to introduce atmospheric air into the liquid container via the atmospheric air introduction port that is open in the liquid container; and a terminal part stored in the liquid container and configured to detect the liquid in the liquid container, the liquid container having a recess constitution wall part in which a recess is formed in the liquid container, the recess being open downward and having blocked upper and lateral sides while the tank is in a liquid supply posture in which the liquid is supplied to the liquid jetting head that is jetting the liquid, the recess constitution wall part being arranged at an upper portion of the liquid container while the tank is in the liquid supply posture, the terminal part being attached to the recess constitution wall part, and the liquid injection port and the atmospheric air introduction port being provided in a section excluding the recess, in the liquid container.

2. The tank according to claim 1,
wherein a posture of the tank when the liquid is injected into the liquid container via the liquid injection port is the same as the liquid supply posture.

3. The tank according to claim 1,
wherein a through hole that communicates with the outside of the liquid container and in which at least a portion of the terminal part is arranged, is provided in the recess constitution wall part, and
a sealing member that holds the terminal part is arranged between an inner peripheral surface of the through hole and the terminal part.

4. The tank according to claim 1,
wherein the liquid container includes:
an upper wall part that is positioned above the liquid container and extends in a direction intersecting the gravity direction when the tank is in the liquid supply posture;
a bottom wall part that is positioned below the liquid container, faces the upper wall part, and extends in a direction intersecting the gravity direction when the tank is in the liquid supply posture; and
a partition wall part that extends from the upper wall part to a position between the upper wall part and the bottom wall part so as to partition a space in the liquid container, and
the partition wall part is positioned, as a portion of the recess constitution wall part, lateral to the space in the recess.

5. The tank according to claim 1, further comprising:
a case member that is a box body that is open in one direction; and
a sheet member that is joined to the case member so as to seal the opening of the case member,
wherein the liquid container is positioned between the case member and the sheet member, and
an inner wall surface of the recess is constituted by an inner wall surface of the case member and a surface of the sheet member.

6. The tank according to claim 1,
wherein a sidewall of the recess that is a portion of the recess constitution wall part is constituted by a wall part of a cylindrical part protruding outward of the liquid container.

7. The tank according to claim 1,
wherein the terminal part is provided in an upper end wall part positioned on an upper side in the recess when the tank is in the liquid supply posture.

8. The tank according to claim 1,
wherein the terminal part is provided in a sidewall of the recess.

9. The tank according to claim 1,
wherein the terminal part is provided at a position higher than the liquid injection port in the recess when the tank is in the liquid supply posture.

10. The tank according to claim 1,
wherein the liquid injection part includes a liquid intake port that is open outward of the tank, and
the terminal part is provided at a position higher than the liquid intake port in the recess constitution wall part when the tank is in the liquid supply posture.

11. The tank according to claim 1,
wherein the recess constitution wall part includes a through hole that communicates with an outside of the tank, and the terminal part is arranged so as to pass through the through hole and extend from the liquid container to the outside of the tank.

12. The tank according to claim 1,
wherein the liquid container has an upper wall part that is positioned above the liquid container and extends in a direction intersecting the gravity direction when the tank is in the liquid supply posture, and
the upper wall part includes at least:
a first upper wall part that, when the tank is in the liquid supply posture, extends in a direction intersecting the gravity direction and is positioned, as a portion of the recess constitution wall part, above a space in the recess;
a sidewall part that extends downward from the first upper wall part and is positioned, as a portion of the recess constitution wall part, lateral to the space in the recess when the tank is in the liquid supply posture; and
a second upper wall part that is at a position lower than the first upper wall part and extends from the sidewall part in a direction that intersects the gravity direction and is a direction of separating from the recess when the tank is in the liquid supply posture.

13. The tank according to claim 12,
wherein the upper wall part further includes:
a third upper wall part that is positioned at a position higher than the second upper wall part and extends in a direction intersecting the gravity direction when the tank is in the liquid supply posture,
the third upper wall part is on an opposite side to the first upper wall part and sandwiches the sidewall part and the second upper wall part with the first upper wall part, and
the liquid injection port and the atmospheric air introduction port are formed so as to be open toward a region positioned below the third upper wall part when the tank is in the liquid supply posture.

14. The tank according to claim 1, further comprising:
a first sidewall part and a second sidewall part that face each other and sandwich the liquid container in a direction intersecting the gravity direction when the tank is in the liquid supply posture,
wherein the liquid injection port is positioned between the first sidewall part side and a center between the first sidewall part and the second sidewall part in a direction from the first sidewall part to the second sidewall part, and the terminal is provided in the recess constitution wall part between the second sidewall part side and the center between the first sidewall part and the second sidewall part.

15. The tank according to claim 14,
wherein at least a portion of the atmospheric air introduction part is positioned, in the direction from the first sidewall part toward the second sidewall part, between the liquid injection part and the section in the recess constitution wall part in which the terminal part is provided, and protrudes above the liquid injection part and the section in the recess constitution wall part in which the terminal part is provided when the tank is in the liquid supply posture.

* * * * *